US011939650B2

(12) United States Patent
Yabu et al.

(10) Patent No.: US 11,939,650 B2
(45) Date of Patent: Mar. 26, 2024

(54) HOT-ROLLED STEEL SHEET

(71) Applicant: NIPPON STEEL CORPORATION, Tokyo (JP)

(72) Inventors: Shohei Yabu, Tokyo (JP); Kunio Hayashi, Tokyo (JP); Yuji Yamaguchi, Tokyo (JP); Marina Mori, Tokyo (JP); Naoki Inoue, Tokyo (JP); Genki Abukawa, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 496 days.

(21) Appl. No.: 17/295,298

(22) PCT Filed: Nov. 20, 2019

(86) PCT No.: PCT/JP2019/045397
§ 371 (c)(1),
(2) Date: May 19, 2021

(87) PCT Pub. No.: WO2020/110855
PCT Pub. Date: Jun. 4, 2020

(65) Prior Publication Data

US 2022/0389545 A1 Dec. 8, 2022

(30) Foreign Application Priority Data

Nov. 28, 2018 (JP) ..... 2018-222296

(51) Int. Cl.
*C22C 38/06* (2006.01)
*C21D 8/02* (2006.01)
(Continued)

(52) U.S. Cl.
CPC ..... *C22C 38/06* (2013.01); *C21D 8/0205* (2013.01); *C21D 8/0226* (2013.01); *C21D 9/46* (2013.01);
(Continued)

(58) Field of Classification Search
None
See application file for complete search history.

(56) References Cited

U.S. PATENT DOCUMENTS

2010/0047617 A1 2/2010 Sugiura et al.
2013/0167985 A1 7/2013 Saito et al.
(Continued)

FOREIGN PATENT DOCUMENTS

CN 103459648 A 12/2013
CN 103562427 A 2/2014
(Continued)

OTHER PUBLICATIONS

"Metallic materials—Bend test (Amendment 1)", JIS Z 2248, 2014, total 1 page.
(Continued)

*Primary Examiner* — Anthony M Liang
(74) *Attorney, Agent, or Firm* — Birch, Stewart, Kolasch & Birch, LLP

(57) ABSTRACT

A hot-rolled steel sheet includes, as chemical composition, C, Si, Mn, and sol.Al. In the hot-rolled steel sheet, an average of pole densities in crystal orientation group consisting of {110}<110> to {110}<001> in surface region is 0.5 to 3.0, a standard deviation of the pole densities in the crystal orientation group is 0.2 to 2.0, and the tensile strength is 780 to 1370 MPa.

5 Claims, 2 Drawing Sheets

(51) Int. Cl.
*C21D 9/46* (2006.01)
*C22C 38/02* (2006.01)
*C22C 38/04* (2006.01)

(52) U.S. Cl.
CPC ..... *C22C 38/02* (2013.01); *C22C 38/04* (2013.01); *C21D 2201/05* (2013.01)

(56) References Cited

U.S. PATENT DOCUMENTS

| | | | |
|---|---|---|---|
| 2013/0323112 | A1 | 12/2013 | Okamoto et al. |
| 2014/0014237 | A1 | 1/2014 | Yokoi et al. |
| 2014/0087208 | A1 | 3/2014 | Toda et al. |
| 2014/0110022 | A1 | 4/2014 | Sano et al. |
| 2017/0044638 | A1 | 2/2017 | Yokoi et al. |

FOREIGN PATENT DOCUMENTS

| | | | | |
|---|---|---|---|---|
| JP | 2007-46146 A | | 2/2007 | |
| JP | 2007046146 A | * | 2/2007 | ..... C21D 9/46 |
| JP | 2008-274395 A | | 11/2008 | |
| JP | 2012-62558 A | | 3/2012 | |
| JP | 2012-77336 A | | 4/2012 | |
| JP | 2013-133499 A | | 7/2013 | |
| JP | 2017-057472 A | | 3/2017 | |
| JP | 2017-206764 A | | 11/2017 | |
| KR | 10-1632778 B1 | | 6/2016 | |
| WO | WO 2012/121219 A1 | | 9/2012 | |
| WO | WO 2015-162932 A1 | | 10/2015 | |

OTHER PUBLICATIONS

"Metallic materials—Bend test", JIS Z 2248, 2006, total 9 pages.
"Metallic materials-Tensile testing—Method of test at room temperature", JIS Z 2241, 2011, total 37 pages.
Yamazaki et al., Influence of Microstructure on Bendability of Ultrahigh-Strength Steel Sheet-Formability of Ultrahigh-Strength Steel Sheet I, Journal of the Japan Society for Technology of Plasticity, 1995, vol. 36, No. 416, p. 973, total 4 pages.

* cited by examiner

HOT-ROLLED STEEL SHEET

TECHNICAL FIELD OF THE INVENTION

The present invention relates to a high strength hot-rolled steel sheet having excellent bending workability and small anisotropy in bending workability.

Priority is claimed on Japanese Patent Application No. 2018-222296, filed in Japan on Nov. 28, 2018, and the content of which is incorporated herein by reference.

RELATED ART

There has been a demand for both improving fuel efficiency of vehicles and securing collision safety, the high-strengthening of steel sheets for vehicles has been promoted, and high strength steel sheets have often been used for vehicle bodies.

A hot-rolled steel sheet manufactured by hot rolling has been widely used for a material for a structural member for vehicles and industrial equipment as a relatively cheap structural material. Particularly, from the viewpoint of weight reduction, durability, shock absorption properties, and the like, high-strengthening of a hot-rolled steel sheet used for a vehicle suspension component, a bumper component, a shock absorption member, or the like has been promoted, and at the same time, excellent formability that can withstand forming into a complicated shape has also been required.

However, since the formability of the hot-rolled steel sheet tends to decrease with high-strengthening of the material, it is a difficult problem to achieve both high strength and good formability.

Particularly, in recent years, there has been an increasing demand for weight reduction of a vehicle suspension component, and it has been an important problem to realize a high tensile strength of 780 MPa or more and excellent bending workability.

For example, in Non-Patent Document 1, it is reported that bending workability is improved by controlling the structure to a single structure of ferrite, bainite, martensite, and the like by microstructure control.

Patent Document 1 discloses a method for realizing a tensile strength of 590 MPa or more and 750 MPa or less and excellent bending workability by containing, by mass %, 0.010 to 0.055% of C, 0.2% or less of Si, 0.7% or less of Mn, 0.025% or less of P, 0.02% or less of S, 0.01% or less of N, 0.1% or less of Al, and 0.06 to 0.095% of Ti, controlling the structure to a structure including ferrite at an area ratio of 95% or more, and controlling the structure to a structure in which only carbide particle containing Ti and TiS having an average diameter of 0.5 μm or less as sulfide containing Ti are dispersed and precipitated in the ferrite grains.

However, although excellent bending workability can be realized by the technique of Patent Document 1, it is not possible to realize a high strength of 780 MPa or more since it is required that the structure is controlled to a ferrite single phase structure.

On the other hand, Patent Document 2 discloses a method for improving bending workability while maintaining a tensile strength of 780 MPa or more by containing, by mass %, 0.05 to 0.15% of C, 0.2 to 1.2% of Si, 1.0 to 2.0% of Mn, 0.04% or less of P, 0.0030% or less of S, 0.005 to 0.10% of Al, 0.005% or less of N, and 0.03 to 0.13% of Ti, controlling the structure inside the steel sheet to a bainite single phase or a structure including bainite at a fraction of more than 95%, and setting the fraction of a bainite phase to less than 80% and the fraction of ferrite rich in workability to 10% or more in the structure of the sheet surface layer area.

Further, Patent Document 3 discloses a high strength hot-rolled steel sheet having a high yield strength of 960 MPa or more, excellent bending workability, and excellent low temperature toughness obtained by containing, by mass %, 0.08 to 0.25% of C, 0.01 to 1.0% of Si, 0.8 to 1.5% of Mn, 0.025% or less of P, 0.005% or less of S, 0.005 to 0.10% of Al, 0.001 to 0.05% of Nb, 0.001 to 0.05% of Ti, 0.1 to 1.0% of Mo, and 0.1 to 1.0% of Cr and controlling the structure to a structure in which a tempered martensite phase is a primary phase with a volume percentage of 90% or more, and the anisotropy of prior γ grains in which an average grain size of prior austenite grains is 20 μm or less in a cross section parallel to a rolling direction, and the average grain size of prior austenite grains is 15 μm or less in a cross section orthogonal to the rolling direction is reduced.

However, in recent years, in order to achieve high-strength, elements such as Nb and Ti have often been included and finish rolling has often been performed at a low temperature. Therefore, the anisotropy in the bending workability of a hot-rolled steel sheet is large, and the problem of limiting a blanking direction before forming becomes apparent.

Patent Document 4 discloses a hot-rolled steel sheet having excellent local deformability and small anisotropy in bending workability obtained by controlling the pole density of each orientation of a specific crystal orientation group at the central portion in a sheet thickness direction, which is from the sheet surface to ⅝ to ⅜ of a sheet thickness, and setting rC, which is the Lankford value in a direction perpendicular to a rolling direction, to 0.70 or more and 1.10 or less and r30, which is the Lankford value in a direction at an angle of 30° to the rolling direction, to 0.70 or more and 1.10 or less.

PRIOR ART DOCUMENT

Patent Document

[Patent Document 1] Japanese Unexamined Patent Application, First Publication No. 2013-133499

[Patent Document 2] Japanese Unexamined Patent Application, First Publication No. 2012-62558

[Patent Document 3] Japanese Unexamined Patent Application, First Publication No. 2012-77336

[Patent Document 4] PCT International Publication No. WO 2012/121219

Non-Patent Document

[Non-Patent Document 1] Journal of the Japan Society for Technology of Plasticity, vol. 36 (1995), No. 416, p. 973

DISCLOSURE OF THE INVENTION

Problems to be Solved by the Invention

As described above, it is currently required to increase the strength of a steel sheet and further improve bending workability and anisotropy thereof. However, with the techniques in Patent Documents 1 to 4 described above, it cannot be said that the improvement of strength, bending workability and anisotropy is sufficient. An object of the present invention is to provide a high strength hot-rolled steel sheet having excellent bending workability and small anisotropy in bending workability.

The above-mentioned bending workability is an index indicating that cracks are unlikely to initiate from the outside of bending even in bending having a small bend radius R or an index indicating that cracks are unlikely to propagate.

Means for Solving the Problem

An aspect of the present invention employs the following.

(1) A hot-rolled steel sheet according to an aspect of the present invention includes, as a chemical composition, by mass %, 0.030 to 0.400% of C, 0.050 to 2.5% of Si, 1.00 to 4.00% of Mn, 0.001 to 2.0% of sol.Al, 0 to 0.20% of Ti, 0 to 0.20% of Nb, 0 to 0.010% of B, 0 to 1.0% of V, 0 to 1.0% of Cr, 0 to 1.0% of Mo, 0 to 1.0% of Cu, 0 to 1.0% of Co, 0 to 1.0% of W, 0 to 1.0% of Ni, 0 to 0.01% of Ca, 0 to 0.01% of Mg, 0 to 0.01% of REM, 0 to 0.01% of Zr, limited to 0.020% or less of P, limited to 0.020% or less of S, limited to 0.010% or less of N, and a balance consisting of Fe and impurities, in which, when a surface region is from a sheet surface to 1/10 of a sheet thickness, an average of pole densities in a crystal orientation group consisting of {110}<110> to {110}<001> in the surface region is 0.5 to 3.0, a standard deviation of the pole densities in the crystal orientation group is 0.2 to 2.0, and a tensile strength is 780 to 1370 MPa.

(2) In the hot-rolled steel sheet according to (1), when a central region is from 3/8 to 5/8 of the sheet thickness based on the sheet surface, a pole density in a crystal orientation of {334}<263> may be 1.0 to 7.0.

(3) In the hot-rolled steel sheet according to (1) or (2), the hot-rolled steel sheet may include, as the chemical composition, by mass %, at least one selected from a group consisting of 0.001 to 0.20% of Ti, 0.001 to 0.20% of Nb, 0.001 to 0.010% of B, 0.005 to 1.0% of V, 0.005 to 1.0% of Cr, 0.005 to 1.0% of Mo, 0.005 to 1.0% of Cu, 0.005 to 1.0% of Co, 0.005 to 1.0% of W, 0.005 to 1.0% of Ni, 0.0003 to 0.01% of Ca, 0.0003 to 0.01% of Mg, 0.0003 to 0.01% of REM, and 0.0003 to 0.01% of Zr.

Effects of the Invention

According to the above aspects of the present invention, it is possible to obtain a hot-rolled steel sheet having a tensile strength (maximum tensile strength) of 780 MPa or more, excellent bending workability, and small anisotropy in bending workability.

EMBODIMENTS OF THE INVENTION

Hereinafter, a hot-rolled steel sheet according to an embodiment of the present invention is described in detail. However, the present invention is not limited only to the configuration which is disclosed in the embodiment, and various modifications are possible without departing from the aspect of the present invention. In addition, the limitation range as described below includes a lower limit and an upper limit thereof. However, the value expressed by "more than" or "less than" does not include in the limitation range. "%" of the amount of respective elements expresses "mass %".

First, the background leading to the idea of the hot-rolled steel sheet according to the embodiment will be described.

Figure 1:
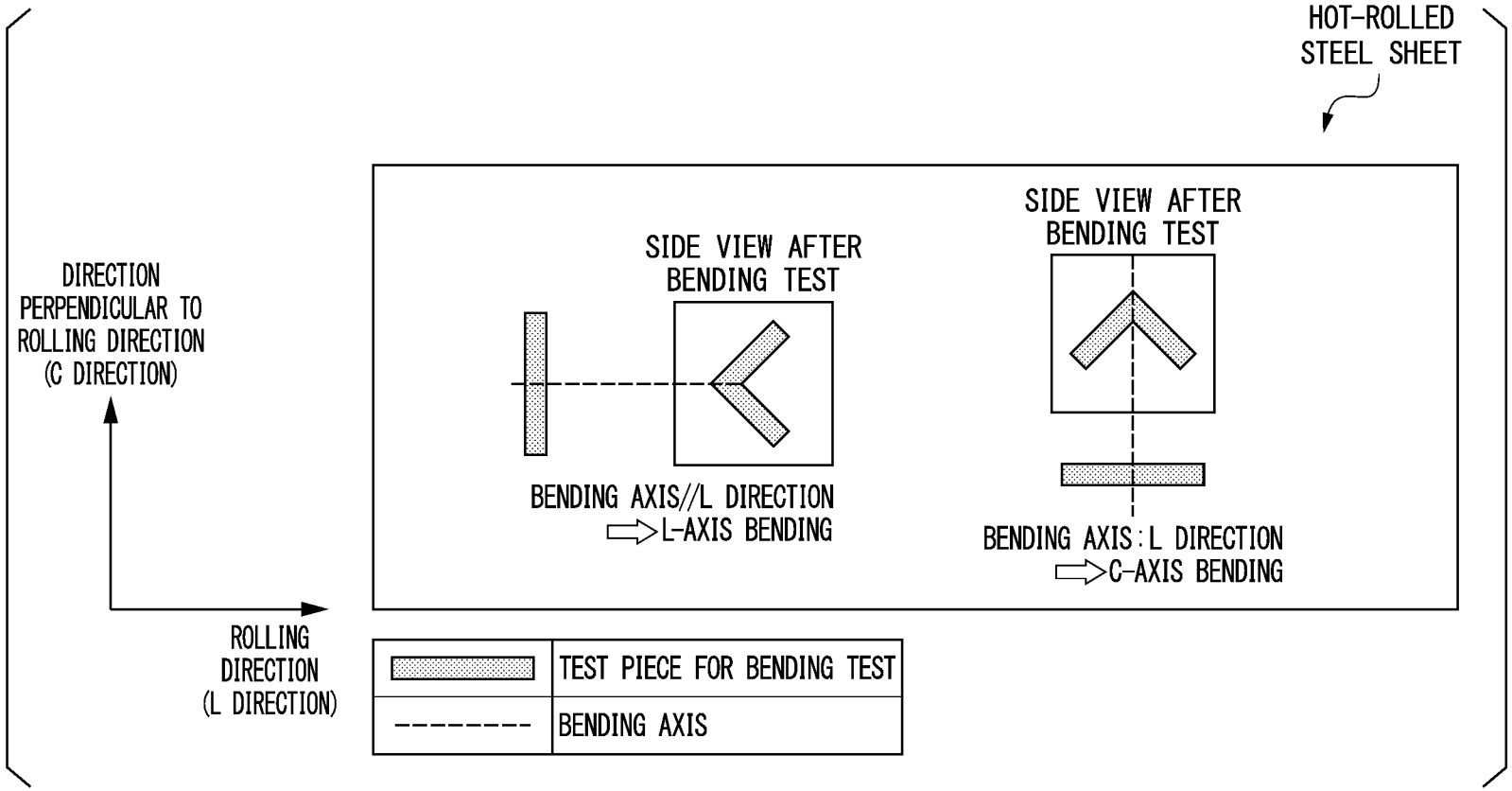
FIG. 1 is a schematic view of a hot-rolled steel sheet and is a view showing a sampling direction of a test piece for a bending test and a bending direction for the bending test.

The present inventors have conducted an intensive investigation on factors that cause anisotropy in bending workability, and have found that bending anisotropy is caused by the texture of a hot-rolled steel sheet, and as shown in FIG. 1, bending anisotropy is largest between bending (L-axis bending) where the bending ridge is parallel to the rolling direction (L direction) and bending (C-axis bending) where the bending ridge is parallel to the direction perpendicular to the rolling direction (C direction).

In addition, in the related art, it has been generally recognized that the bending workability at the time of L-axis bending is inferior to the bending workability at the time of C-axis bending due to inclusions such as MnS stretched in the rolling direction, but it has been found that, in a case where the anisotropy in bending workability due to the texture of the steel sheet is exhibited, contrary to the recognition in the related art, the bending workability at the time of C-axis bending may be inferior to the bending workability at the time of L-axis bending.

Further, since the anisotropy in bending workability is more strongly affected by the texture of the sheet surface region where bending deformation is the most severe than by the texture of the central region of the sheet thickness, it is clarified that the anisotropy between the L-axis bending and the C-axis bending cannot be sufficiently improved unless the texture control of the sheet surface region is performed.

In the techniques described in Patent Documents 2 and 3, although excellent bending workability is obtained by microstructure control, texture control is not performed at all and bending workability at the time of L-axis bending is improved. However, there is a problem that it is difficult to stably secure excellent bending workability at the time of C-axis bending.

In addition, in the technique described in Patent Document 4, although the texture of the central region of the sheet thickness is controlled, the texture of the sheet surface region is not controlled at all. Therefore, excellent bending workability is obtained in bending in a C direction in which the length of a test piece is along the C direction (that is, L-axis bending) and bending in a 45° direction, but there is a problem that excellent bending workability cannot be obtained in C-axis bending.

As a result of the intensive investigation conducted by the present inventors, it has been found that the texture of the sheet surface region where the bending deformation is the most severe affects the formation of cracks during bending deformation. Further, it has been found that the texture of the central region of the sheet thickness affects the propagation of cracks initiated in the surface region.

Based on the above findings, the present inventors have found that a high strength hot-rolled steel sheet having excellent bending workability in both L-axis bending and C-axis bending can be realized by controlling the texture formed in the sheet surface region in the finish rolling of hot rolling to suppress the anisotropy between the L direction and the C direction. In addition, it has been found that bending workability and its anisotropy can be further preferably improved by controlling the texture of the central region of the sheet thickness after controlling the texture of the sheet surface region.

Specifically, the worked structure in the sheet surface region is controlled by controlling the steel composition within an appropriate range, controlling the sheet thickness and the temperature at the time of hot rolling, and additionally, controlling the sheet thickness, the roll shape ratio, the rolling reduction, and the temperature in the last two stages of rolling at the time of finish rolling of hot rolling which have not been positively controlled in the related art. As a result, it has been found that excellent bending workability is realized in both L-axis bending and C-axis bending since recrystallization is controlled and the texture of the sheet surface region is optimized.

Further, it has been found that in addition to the optimization of the texture of the sheet surface region, the worked structure of the central region of the sheet thickness is controlled by preferably controlling the finish rolling conditions of hot rolling, and as a result, as long as the texture of the central region of the sheet thickness is optimized, the bending workability in both L-axis bending and C-axis bending is further preferably improved.

A hot-rolled steel sheet according to the embodiment includes, as a chemical composition, by mass %, 0.030 to 0.400% of C, 0.050 to 2.5% of Si, 1.00 to 4.00% of Mn, 0.001 to 2.0% of sol.Al, 0 to 0.20% of Ti, 0 to 0.20% of Nb, 0 to 0.010% of B, 0 to 1.0% of V, 0 to 1.0% of Cr, 0 to 1.0% of Mo, 0 to 1.0% of Cu, 0 to 1.0% of Co, 0 to 1.0% of W, 0 to 1.0% of Ni, 0 to 0.01% of Ca, 0 to 0.01% of Mg, 0 to 0.01% of REM, 0 to 0.01% of Zr, limited to 0.020% or less of P, limited to 0.020% or less of S, limited to 0.010% or less of N, and a balance consisting of Fe and impurities. In addition, in the hot-rolled steel sheet according to the embodiment, when a surface region is from a sheet surface to 1/10 of a sheet thickness, an average of pole densities in a crystal orientation group consisting of {110}<110> to {110}<001> in the surface region is 0.5 to 3.0, and a standard deviation of the pole densities in the crystal orientation group is 0.2 to 2.0. In addition, in the hot-rolled steel sheet according to the embodiment, the tensile strength is 780 to 1370 MPa.

In addition, in the hot-rolled steel sheet according to the embodiment, when a central region is from 3/8 to 5/8 of the sheet thickness based on the sheet surface, a pole density in a crystal orientation of {334}<263> is preferably 1.0 to 7.0.

In addition, the hot-rolled steel sheet according to the embodiment may include, as the chemical composition, by mass %, at least one selected from the group consisting of 0.001 to 0.20% of Ti, 0.001 to 0.20% of Nb, 0.001 to 0.010% of B, 0.005 to 1.0% of V, 0.005 to 1.0% of Cr, 0.005 to 1.0% of Mo, 0.005 to 1.0% of Cu, 0.005 to 1.0% of Co, 0.005 to 1.0% of W, 0.005 to 1.0% of Ni, 0.0003 to 0.01% of Ca, 0.0003 to 0.01% of Mg, 0.0003 to 0.01% of REM, and 0.0003 to 0.01% of Zr.

1. Chemical Composition

First, the steel composition and the reason for its limitation will be described. The hot-rolled steel sheet according to the embodiment includes, as the chemical composition, base elements and as required, an optional element, and the balance consists of iron and impurities.

In the chemical composition of the hot-rolled steel sheet according to the embodiment, C, Si, Mn, and Al are base elements (main alloying elements).

(C: 0.030 to 0.400%)

C (carbon) is an important element for securing the strength of the steel sheet. When the C content is less than 0.030%, a tensile strength of 780 MPa or more cannot be secured. Therefore, the C content is set to 0.030% or more and preferably 0.05% or more. On the other hand, when the C content is more than 0.400%, the weldability is deteriorated, and thus the upper limit is set to 0.400%. The C content is preferably 0.30% or less and more preferably 0.20%.

(Si: 0.050 to 2.5%)

Si (silicon) is an important element capable of increasing the material strength by solid solution strengthening. When the Si content is less than 0.050%, the yield strength is decreased, and thus the Si content is set to 0.050% or more. The Si content is preferably 0.1% or more and more preferably 0.3% or more. On the other hand, when the Si content is more than 2.5%, the surface properties are deteriorated and thus the Si content is set to 2.5% or less. The Si content is preferably 2.0% or less and more preferably 1.5% or less.

(Mn: 1.00 to 4.00%)

Mn (manganese) is an effective element for increasing the mechanical strength of the steel sheet. When the Mn content is less than 1.00%, a tensile strength of 780 MPa or more cannot be secured. Therefore, the Mn content is set to 1.00% or more. The Mn content is preferably 1.50% or more and more preferably 2.00% or more. On the other hand, when Mn is added excessively, the structure becomes non-uniform due to Mn segregation, and the bending workability is decreased. Therefore, the Mn content is set to 4.00% or less, preferably 3.00% or less, and more preferably 2.60% or less.

(sol.Al: 0.001 to 2.0%)

sol.Al (acid soluble aluminum) is an element that has an effect of deoxidizing the steel and making the steel sheet sound. When the sol.Al content is less than 0.001%, the steel cannot be sufficiently deoxidized and the sol.Al content is set to 0.001% or more. However, in a case where sufficient deoxidation is required, the sol.Al content is more desirably 0.01% or more and even more desirably 0.02% or more. On the other hand, when the sol.Al content is more than 2.0%, the weldability is significantly decreased, and the amount of oxide-based inclusions is increased, so that the surface properties are significantly deteriorated. Therefore, the sol.Al content is set to 2.0% or less, preferably 1.5% or less, more preferably 1.0% or less, and most preferably 0.08% or less. In addition, sol.Al means an acid soluble Al that does not form an oxide such as $Al_2O_3$ and is soluble in an acid.

The hot-rolled steel sheet according to the embodiment contains impurities as the chemical composition. In addition, the impurities correspond to elements which are contaminated during industrial production of steel from ores and scrap that are used as a raw material of steel, or from environment of a production process. For example, the term "impurities" means elements such as P, S, and N. These impurities are preferably limited as follows in order to fully exert the effects of the embodiment. Further, since it is preferable that the impurity content is small, it is not required to limit the lower limit, and the lower limit of impurities may be 0%.

(P: 0.020% or Less)

P (phosphorus) is an impurity generally contained in the steel. However, since P has an effect of increasing the tensile strength, P may be intentionally contained. However, when the P content is more than 0.020%, the deterioration of weldability becomes significant. Therefore, the P content is limited to 0.020% or less. The P content is preferably limited to 0.010% or less. In order to more reliably obtain the above effect, the P content may be 0.001% or more.

(S: 0.020% or Less)

S (sulfur) is an impurity contained in the steel, and the smaller the amount is, the more preferable it is from the viewpoint of weldability. When the S content is more than 0.020%, the weldability is significantly decreased, the precipitation amount of MnS is increased, and the low temperature toughness is decreased. Therefore, the S content is limited to 0.020% or less. The S content is preferably limited to 0.010% or less and more preferably 0.005% or less. From the viewpoint of desulfurization cost, the S content may be 0.001% or more.

(N: 0.010% or Less)

N (nitrogen) is an impurity contained in the steel, and the smaller the amount is, the more preferable it is from the viewpoint of weldability. When the N content is more than 0.010%, the weldability is significantly decreased. Therefore, the N content is limited to 0.010% or less. The N content is preferably limited to 0.005% or less and more preferably 0.003% or less.

The hot-rolled steel sheet according to the embodiment may contain the optional element in addition to the base elements and the impurities described above. For example, as substitution for a part of Fe which is the balance described above, as the optional element, the steel sheet may include at least one selected from a group consisting of Ti, Nb, B, V, Cr, Mo, Cu, Co, W, Ni, Ca, Mg, REM, and Zr. The optional elements preferably improve the mechanical properties of the hot-rolled steel sheet. The optional elements may be included as necessary. Thus, a lower limit of the respective optional elements does not need to be limited, and the lower limit may be 0%. Moreover, even if the optional elements may be included as impurities, the above mentioned effects are not affected.

(Ti: 0 to 0.20%)

Ti (titanium) is an element that is precipitated as TiC in the ferrite or bainite in the steel sheet structure during cooling or coiling of the steel sheet to contribute to improvement in strength. Therefore, Ti may be contained in the steel. When Ti is added excessively, recrystallization at the time of hot rolling is suppressed and the texture with a specific crystal orientation is developed. Therefore, Rm/t, which is a value obtained by dividing the minimum bend radius required for working for a suspension component having a complicated shape by the sheet thickness, is not 2.0 or less in L-axis bending or C-axis bending or both L-axis bending and C-axis bending. Therefore, the Ti content is set to 0.20% or less. The Ti content is preferably 0.18% or less and more preferably 0.15% or less. In order to preferably obtain the above effect, the Ti content may be 0.001% or more. The Ti content is preferably 0.02% or more.

(Nb: 0 to 0.20%)

Similar to Ti, Nb (niobium) is an element that is precipitated as NbC to improve the strength and significantly suppress the recrystallization of austenite. Therefore, Nb may be contained in the steel. When the Nb content is more than 0.20%, the recrystallization of austenite is suppressed during hot rolling to develop the texture. Thus, Rm/t, which is a value obtained by dividing the minimum bend radius by the sheet thickness, is not 2.0 or less in L-axis bending or C-axis bending or both L-axis bending and C-axis bending. Therefore, the Nb content is set to 0.20% or less. The Nb content is preferably 0.15% or less and more preferably 0.10% or less. In order to preferably obtain the above effect, the Nb content may be 0.001% or more. The Nb content is preferably 0.005% or more.

It is preferable that the hot-rolled steel sheet according to the embodiment includes, as the chemical composition, by mass %, at least one of 0.001 to 0.20% of Ti or 0.001 to 0.20% of Nb.

(B: 0 to 0.010%)

B (boron) is segregated at the grain boundaries to improve the grain boundary strength, so that roughness of the punched cross section at the time of punching can be suppressed. Therefore, B may be contained in the steel. Even when the B content is more than 0.010%, the above effect is saturated, which is economically disadvantageous. Therefore, the upper limit of the B content is set to 0.010%. The B content is preferably 0.005% or less and more preferably 0.003% or less. In order to preferably obtain the above effect, the B content may be 0.001% or more.

(V: 0 to 1.0%)

(Cr: 0 to 1.0%)

(Mo: 0 to 1.0%)

(Cu: 0 to 1.0%)

(Co: 0 to 1.0%)

(W: 0 to 1.0%)

(Ni: 0 to 1.0%)

All of V (vanadium), Cr (chromium), Mo (molybdenum), Cu (copper), Co (cobalt), W (tungsten), and Ni (nickel) are elements effective for stably securing strength. Therefore, these elements may be contained in the steel. However, even when each of the elements is contained in an amount of more than 1.0%, the above effect is likely to be saturated, which may be economically disadvantageous. Therefore, the amount of each of these elements is set to 1.0% or less. The amount of each of these elements is preferably 0.8% or less and more preferably 0.5% or less. In addition, in order to more reliably obtain the above effect, the amount of each element may be 0.005% or more.

It is preferable that the hot-rolled steel sheet according to the embodiment includes, as the chemical composition, by mass %, at least one selected from the group consisting of 0.005 to 1.0% of V, 0.005 to 1.0% of Cr, 0. 005 to 1.0% of Mo, 0.005 to 1.0% of Cu, 0.005 to 1.0% of Co, 0.005 to 1.0% of W, and 0.005 to 1.0% of Ni.

(Ca: 0 to 0.01%)

(Mg: 0 to 0.01%)

(REM: 0 to 0.01%)

(Zr: 0 to 0.01%)

All of Ca (calcium), Mg (magnesium), REM (rare earth element), and Zr (zirconium) are elements that contribute to inclusion control, particularly fine dispersion of inclusions, and enhance toughness. Therefore, these elements may be contained in the steel. However, when each of the elements is contained in an amount of more than 0.01%, deterioration of the surface properties may become apparent. Therefore, the amount of each of these elements is set to 0.01% or less. The amount of each of these elements is preferably 0.005% or less and more preferably 0.003% or less. In order to more reliably obtain the above effect, the amount of each element may be 0.0003% or more.

Here, REM refers to a total of 17 elements including Sc, Y and lanthanoids and is at least one of these elements. The REM content means the total amount of at least one of these elements. In a case where lanthanoid is used, industrially, REM is added in a Mischmetal form.

It is preferable that the hot-rolled steel sheet according to the embodiment includes, as the chemical composition, at least one selected from the group consisting of 0.0003 to 0.01% of Ca, 0.0003 to 0.01% of Mg, 0.0003 to 0.01% of REM, and 0.0003 to 0.01% of Zr.

The above-mentioned steel composition may be measured by a general method for analyzing steel. For example, the steel composition may be measured by using ICP-AES (Inductively Coupled Plasma-Atomic Emission Spectrometer: inductively coupled plasma emission spectroscopy spectrometry). The amount of sol.Al may be measured by ICP-AES using a filtrate after a sample is thermally decomposed with an acid. In addition, C and S may be measured by the infrared absorption method after combustion, N may be measured by the thermal conductometric method after fusion in a current of inert gas, and O may be measured by, for example, the non-dispersive infrared absorption method after fusion in a current of inert gas.

2. Texture

Next, the texture of the hot-rolled steel sheet according to the embodiment will be described.

The hot-rolled steel sheet according to the embodiment has a texture in which, when a surface region is from a sheet surface to 1/10 of a sheet thickness, an average of pole densities in a crystal orientation group consisting of {110}<110> to {110}<001> in the surface region is 0.5 to 3.0, and a standard deviation of the pole densities in the crystal orientation group is 0.2 to 2.0.

(Surface Region from Sheet Surface to 1/10 of Sheet Thickness)

When the steel sheet is bent and deformed, the strain increases toward the surface with the center of the sheet thickness as the boundary, and the strain becomes maximum at the outermost surface. Therefore, bending cracks are initiated on the surface of the steel sheet. Since it is the structure of the surface region from the sheet surface to 1/10 of the sheet thickness to contribute to the initiation of cracks as described above, the texture of the surface region is controlled.

(In Surface Region, Average of Pole Densities in Crystal Orientation Group Consisting of {110}<110> to {110}<001> in Surface Region is 0.5 to 3.0, and Standard Deviation of Pole Densities in Crystal Orientation Group is 0.2 to 2.0)

When the average of pole densities of the crystal orientation group consisting of {110}<110> to {110}<001> in the surface region from the sheet surface to 1/10 of the sheet thickness is more than 3.0, the region where deformation localization occurs increases, which causes bending cracks. Thus, Rm/t, which is a value obtained by dividing the minimum bend radius by the sheet thickness, cannot satisfy 2.0 or less in L-axis bending or C-axis bending or both L-axis bending and C-axis bending. Therefore, the average of pole densities of the crystal orientation group consisting of {110}<110> to {110}<001> is set to 3.0 or less. The average of pole densities of the crystal orientation group is preferably 2.5 or less and more preferably 2.0 or less.

The smaller the average of pole densities of the crystal orientation group consisting of {110}<110> to {110}<001> is, the more preferable it is. However, in a high strength hot-rolled steel sheet having a tensile strength of 780 MPa or more, it is difficult to set this value to less than 0.5, and thus the lower limit is practically 0.5.

When the distribution of the crystal orientation group consisting of {110}<110> to {110}<001> in the surface region from the sheet surface to 1/10 of the sheet thickness is uneven, the anisotropy in bending workability is increased. When the standard deviation of the pole densities in each orientation of the crystal orientation group consisting of {110}<110> to {110}<001> is more than 2.0, the anisotropy between L-axis bending and C-axis bending is increased, and Rm/t, which is a value obtained by dividing the minimum bend radius by the sheet thickness, cannot satisfy 2.0 or less in L-axis bending or C-axis bending or both L-axis bending and C-axis bending. Therefore, the standard deviation of the pole densities of the crystal orientation group consisting of {110}<110> to {110}<001> is set to 2.0 or less. The standard deviation of the pole densities of the crystal orientation group is preferably 1.5 or less and more preferably 1.0 or less.

The smaller the standard deviation of the pole densities of the crystal orientation group consisting of {110}<110> to {110}<001> is, the more preferable it is. However, in a high strength hot-rolled steel sheet having a tensile strength of 780 MPa or more, it is difficult to set the value to less than 0.2, and thus the lower limit is practically 0.2.

The hot-rolled steel sheet according to the embodiment preferably has a texture in which a pole density in a crystal orientation of {334}<263> is 1.0 to 7.0 when a central region is from 3/8 to 5/8 of the sheet thickness based on the sheet surface.

(Central Region from 3/8 to 5/8 of Sheet Thickness Based on Sheet Surface)

When bending cracks are initiated in the surface region by deforming the steel sheet by bending, the bending cracks may be propagated toward the central region of the sheet thickness. Since the central region from 3/8 to 5/8 of the sheet thickness based on the sheet surface mainly contributes to such progress of bending cracks, it is preferable to control the texture of this region.

(In Central Region, Pole Density in Crystal Orientation of {334}<263> is 1.0 to 7.0)

By controlling the pole density of the crystal orientation of {334}<263> in the central region from 3/8 to 5/8 of the sheet thickness to 7.0 or less, more excellent bending workability can be preferably obtained in both the L direction and the C direction. For example, when the average of pole densities of the crystal orientation group consisting of {110}<110> to {110}<001> in the surface region is 0.5 to 3.0, the standard deviation of the pole densities of the crystal orientation group is 0.2 to 2.0, and the pole density of the crystal orientation of {334}<263> in the central region is 7.0 or less, Rm/t, which is a value obtained by dividing the minimum bend radius by the sheet thickness, satisfies 1.5 or less in both the L direction and the C direction. Therefore, it is preferable that the pole density of the crystal orientation of {334}<263> is 7.0 or less. The pole density of the crystal orientation is more preferably 6.0 or less and even more preferably 5.0 or less.

The smaller the pole density of the crystal orientation of {334}<263> is, the more preferable it is. However, in a high strength hot-rolled steel sheet having a tensile strength of 780 MPa or more, it is difficult to control the pole density to less than 1.0. Thus, the lower limit is practically 1.0.

The pole density can be measured by an electron backscatter diffraction pattern (EBSP) method. In a sample to be subjected to analysis by the EBSP method, a cut surface parallel to the rolling direction and perpendicular to the sheet surface is mechanically polished and then strain is removed by chemical polishing or electrolytic polishing. This sample is used to perform analysis by the EBSP method such that the measurement interval is set to 4 gm and the measurement area is set to 150000 $\mu m^2$ or more in a range from the sheet surface to 1/10 of the sheet thickness or as required, in a range from 3/8 to 5/8 of the sheet thickness.

Figure 2:
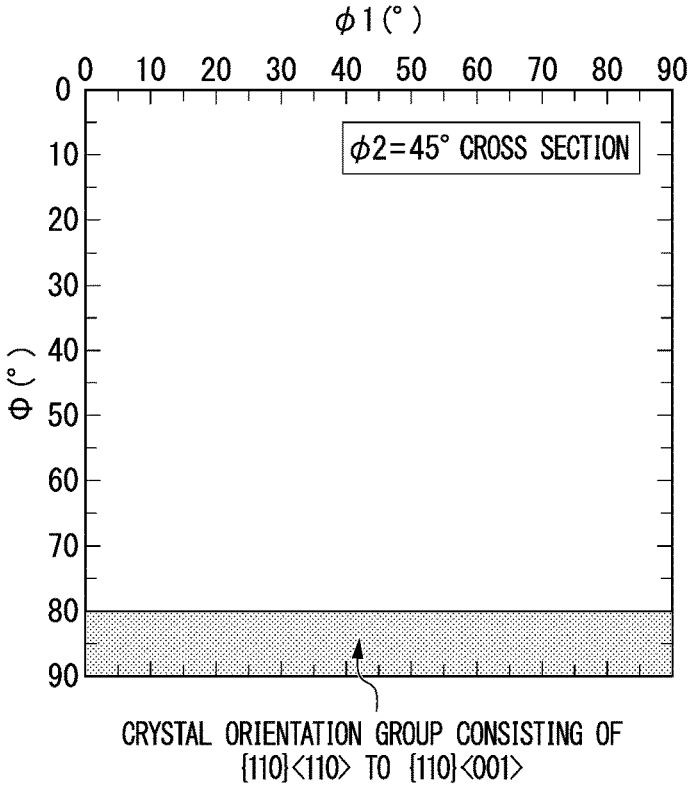
FIG. 2 is a diagram showing crystallite orientation distribution functions (ODF) at a φ2=45° cross section and a crystal orientation group consisting of {110}<110> to {110}<001>.

FIG. 2 shows crystallite orientation distribution functions (ODF) at a $\varphi 2=45°$ cross section and a crystal orientation group consisting of {110}<110> to {110}<001>. The crystal orientation group consisting of {110}<110> to {110}<001> refers to a range of φ1=0° to 90° from a crystal orientation of {110}<110> (φ1=0°, Φ=90.0°, φ2=45.0°) to a crystal orientation of {110}<001> (φ1=90.0°, Φ=90.0°, φ2=45.0°) in the Bunge notation of texture analysis using crystallite orientation distribution functions (ODF) at a φ2=45° cross section. However, since there is a measurement error due to test piece working and sample setting, in the hot-rolled steel sheet according to the embodiment, the average of pole densities and the standard deviation of the crystal orientation group consisting of {110}<110> to {110}<001> are calculated in the hatched portion (within a range of Φ=80° to 90° and φ1=0° to 90°) shown in FIG. 2.

In addition, in the crystal orientation group consisting of {110}<110> to {110}<001>, crystal orientations of {110}<110>, {110}<111>, {110}<223>, {110}<112>, and {110}<001> are included.

Here, for the crystal orientation of the rolled sheet, a lattice plane parallel to the sheet surface is usually expressed by (hkl) or {hkl}, and an orientation parallel to the rolling direction is expressed by [uvw] or <uvw>. Note that {hkl} and <uvw>are general terms for equivalent lattice planes and directions, and (uvw) and [hkl] refer to individual lattice planes and directions. That is, in the hot-rolled steel sheet according to the embodiment, the bcc structure is covered, and thus, for example, (110), (−110), (1−10), (−1−10), (101), (−101), (10−1), (−10−1), (011), (0−11), (01−1), and (0−1−1) are equivalent lattice planes and cannot be distinguished. In this case, these lattice planes are collectively referred to as {110}.

The crystal orientation group consisting of {110}<110> to {110}<001> indicates orientations in which a deformation resistance value is changed depending on the value of φ1. For example, when the angle of φ1 is 0° to 45°, the deformation resistance at the time of deformation in the L direction becomes large, and when the angle of φ1 is 45° to 90°, the deformation resistance at the time of deformation in the C direction becomes large. Thus, in the texture in which this crystal orientation group is developed, when the steel sheet is deformed in the L direction or the C direction, deformation localization due to a difference in the amount of deformation occurs between the crystal in the orientation in which the deformation resistance is large and the crystal in the orientation in which the deformation resistance is small and becomes a crack initiation origin.

Figure 3:
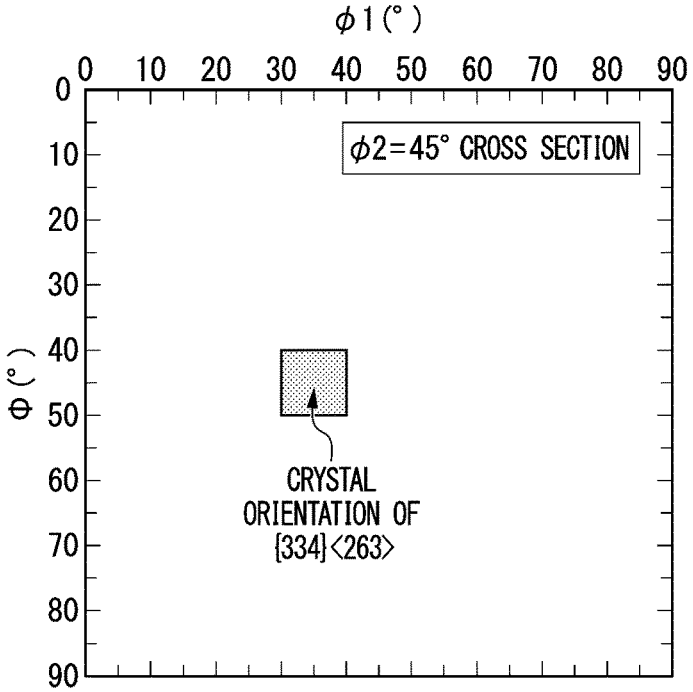
FIG. 3 is a diagram showing crystallite orientation distribution functions (ODF) at a φ2=45° cross section and a crystal orientation of {334}<263>.

FIG. 3 shows crystallite orientation distribution functions (ODF) at a φ2=45° cross section and a crystal orientation of {334}<263>. The crystal orientation of {334}<263> refers to (φ1=36.1°, Φ=46.7°, φ2=45.0°) in the Bunge notation of texture analysis using crystallite orientation distribution functions (ODF) at a φ2=45° cross section. However, since there is a measurement error due to test piece working and sample setting, in the hot-rolled steel sheet according to the embodiment, an average strength in the hatched portion (within a range of Φ=40° to 50° and φ1=30° to 40°) shown in FIG. 3 is calculated as the pole density of the crystal orientation of {334}<263>.

Since the crystal orientation of {334}<263> has a large deformation resistance in both the L direction and the C direction, the development of this crystal orientation causes deformation localization due to a difference in deformation resistance with other crystal orientations, and thus these deformation concentration points promote the propagation of cracks, thereby deteriorating the bendability.

3. Steel Sheet Structure

In the hot-rolled steel sheet according to the embodiment, the texture may be controlled as described above, and the constituent phase of the steel structure is not particularly limited.

However, the hot-rolled steel sheet according to the embodiment may contain a compound such as ferrite, bainite, fresh martensite, tempered martensite, pearlite, residual austenite, or carbonitride as a constituent phase of the steel structure.

For example, it is preferable that the steel sheet includes, by area%, 0 to 70% of ferrite, 0 to 100% of bainite and tempered martensite in total (may be a bainite and tempered martensite single structure), 25% or less of residual austenite, 0 to 100% of fresh martensite (may be a martensite single structure), and 5% or less of pearlite. It is preferable that the balance excluding the above constituent phase is limited to 5% or less.

4. Mechanical Properties

Next, the mechanical properties of the hot-rolled steel sheet according to the embodiment will be described.

(Tensile Strength is 780 to 1370 MPa)

It is preferable that the hot-rolled steel sheet according to the embodiment has sufficient strength to contribute to weight reduction of vehicles. Therefore, the maximum tensile strength (TS) is set to 780 MPa or more. The maximum tensile strength is preferably 980 MPa or more. The upper limit of the maximum tensile strength does not need to be set in particular, but for example, this upper limit may be set to 1370 MPa. In addition, the hot-rolled steel sheet according to the embodiment preferably has a total elongation (EL) of 7% or more. The tensile test may be performed according to JIS Z2241 (2011).

Since the hot-rolled steel sheet according to the embodiment satisfies the above-mentioned steel composition, texture, and tensile strength, Rm/t, which is a value obtained by dividing the minimum bend radius by the sheet thickness (minimum bend radius±sheet thickness), is 2.0 or less in any of bending tests along a rolling direction (L direction) and a direction perpendicular to the rolling direction (C direction).

Rm represents the minimum bend radius, and t represents the thickness of the hot-rolled steel sheet. For example, the bending test may be performed according to JIS Z 2248 (2014) (V block 90° bending test) for both bending (L-axis bending) where the bending ridge is parallel to the rolling direction (L direction) and bending (C-axis bending) where the bending ridge is parallel to the direction perpendicular to the rolling direction (C direction) by cutting out a strip-shaped test piece from a ½ position in the width direction of the hot-rolled steel sheet. Whether or not a crack is initiated on the outside of the bending is investigated, and the minimum bend radius Rm at which the crack is not initiated is obtained.

5. Manufacturing Method

Next, a preferable method for manufacturing the hot-rolled steel sheet according to the embodiment will be described.

The method for manufacturing the hot-rolled steel sheet according to the embodiment is not limited to the following method. The following manufacturing method is an example for manufacturing the hot-rolled steel sheet according to the embodiment.

It is important to suppress the initiation of bending cracks during bending deformation in both the L direction and the C direction by controlling the texture of the sheet surface region that undergoes the most severe bending deformation in order to obtain excellent bending workability in both the L direction and the C direction. Further, it is desirable that minute cracks initiated on the sheet surface region are not propagated to the inside by reducing the pole density in a predetermined orientation of the central region of the sheet thickness. The manufacturing conditions for satisfying these conditions are shown below.

The manufacturing step performed before hot rolling is not particularly limited. That is, various secondary smelting may be performed subsequent to melting by a blast furnace or an electric furnace, and then casting may be performed by a method such as ordinary continuous casting, casting by an ingot method, thin slab casting, or the like. In a case of continuous casting, a cast slab may be cooled to a low temperature, then heated again and then hot-rolled, or a cast slab may be hot-rolled as it is after casting without being cooled to a low temperature. Scrap may be used as a raw material.

The cast slab is heated. In this heating step, the slab is heated to a temperature of 1200° C. to 1300° C., and then retained for 30 minutes or longer. Since Ti and Nb-based precipitates are not sufficiently dissolved at a heating temperature lower than 1200° C., sufficient precipitation hardening cannot be obtained during hot rolling in the subsequent step, and the precipitates remain in the steel as coarse carbides. Thus, formability is deteriorated. Therefore, the heating temperature of the slab is set to 1200° C. or higher. On the other hand, since the amount of scale generated is increased and the yield is decreased at a heating temperature higher than 1300° C., the heating temperature is set to 1300° C. or lower. In order to sufficiently dissolve the Ti and Nb-based precipitates, it is preferable to retain the steel sheet in this temperature range for 30 minutes or longer. In addition, in order to suppress excessive scale loss, the retention time is preferably 10 hours or shorter and more preferably 5 hours or shorter.

The heated slab is subjected to rough rolling. In the rough rolling step, the thickness of the rough-rolled sheet after rough rolling is controlled to more than 35 mm and 45 mm or less. The thickness of the rough-rolled sheet affects the amount of temperature decrease from the tip end to the tail end of the rolled sheet that occurs from the start of rolling to the completion of rolling in a finish rolling step. In addition, when the thickness of the rough-rolled sheet is 35 mm or less or more than 45 mm, the amount of strain introduced into the steel sheet during the finish rolling, which is the next step, is changed, and the worked structure formed during the finish rolling is changed. As a result, the recrystallization behavior is changed and thus it difficult to obtain a desired texture. In particular, it becomes difficult to obtain the above-mentioned texture in the sheet surface region.

The rough-rolled sheet is subjected to finish rolling. In this finish rolling step, multi-stage finish rolling is performed. The finish rolling start temperature is 1000° C. to 1150° C., and the thickness of the steel sheet (thickness of the rough-rolled sheet) before the start of finish rolling is more than 35 mm and 45 mm or less. In addition, in the rolling one step before the final stage of the multi-stage finish rolling, the rolling temperature is 960° C. to 1015° C. and the rolling reduction is more than 11% and 23% or lower. Further, in the final stage of the multi-stage finish rolling, the rolling temperature is 930° C. to 995° C., and the rolling reduction is more than 11% and 21% or lower. In addition, each condition at the time of the last two stages of rolling is controlled, and a texture forming parameter ω calculated by Equation 1 below satisfies 100 or less. Finish rolling is performed under the above conditions.

[Equation 1]

$$\omega = 0.3\left[\frac{\{1.2\times10^4/F_1^{*+600(Sr_1-0.9)}\}}{FT_1^*}+\frac{\{800/F_2^{*+400(Sr_2-0.9)}\}}{FT_2^*}\right] \quad \text{(Equation 1)}$$

[Equation 2]

$$PE = \begin{cases} 0.01 & (Ti+1.3Nb < 0.02) \\ Ti+1.3Nb-0.01 & (Ti+1.3Nb \geq 0.02) \end{cases} \quad \text{(Equation 2)}$$

[Equation 3]

$$F_1^* = \begin{cases} 1.0 & (F_1 < 12) \\ F_1 - 11 & (F_1 \geq 12) \end{cases} \quad \text{(Equation 3)}$$

[Equation 4]

$$F_2^* = \begin{cases} 0.1 & (F_2 < 11.1) \\ F_2 - 11 & (F_2 \geq 11.1) \end{cases} \quad \text{(Equation 4)}$$

[Equation 5]

$$Sr_1 = \frac{\sqrt{\frac{1}{2}D_1\times(t_1-t_2)}}{\left(\frac{1}{3}(t_1+2t_2)\right)} \quad \text{(Equation 5)}$$

[Equation 6]

$$Sr_2 = \frac{\sqrt{\frac{1}{2}D_2\times(t_2-t_f)}}{\left(\frac{1}{3}(t_2+2t_f)\right)} \quad \text{(Equation 6)}$$

[Equation 7]

$$FT_1^* = \frac{(FT_1-910)}{10PE} \quad \text{(Equation 7)}$$

[Equation 8]

$$FT_2^* = \frac{(FT_2-928)}{20PE} \quad \text{(Equation 8)}$$

Here,

PE: conversion value of recrystallization suppression effect by a precipitate forming element (unit: mass %), Ti: concentration of Ti contained in the steel (unit: mass %), Nb: concentration of Nb contained in the steel (unit: mass %), $F_1$*: converted rolling reduction in one stage before the final stage (unit: %), $F_2$*: converted rolling reduction in the final stage (unit: %), $F_1$: rolling reduction in one stage before the final stage (unit: %), $F_2$: rolling reduction in the final stage (unit: %), $Sr_1$: rolled shape ratio in one stage before the final stage (no unit), $Sr_2$: rolled shape ratio in the final stage (no unit), $D_1$: roll diameter in one stage before the final stage (unit: mm), $D_2$: roll diameter in the final stage (unit: mm), $t_1$: sheet thickness at the start of rolling in one stage before the final stage (unit: mm), $t_2$: sheet thickness at the start of rolling in the final stage (unit: mm), $t_f$: sheet thickness after finish rolling (unit: mm), $FT_1$*: converted rolling temperature in one stage before the final stage (unit: ° C.), $FT_2$*: converted rolling temperature in the final stage (unit: ° C.), $FT_1$: rolling temperature in one stage before the final stage (unit: ° C.), and $FT_2$: rolling temperature in the final stage (unit: ° C.).

However, in Equations 1 to 8, regarding the numbers such as 1 and 2 that are appended to variables as $F_1$ and $F_2$, in the last two stages of rolling in the multi-stage finish rolling, 1 is added to the variable related to rolling in one stage before the final stage, and 2 is added to the variable related to rolling in the final stage. For example, in multi-stage finish rolling including seven stages of rolling in total, $F_1$ means the rolling reduction in the sixth stage counting from the rolling inlet side, and $F_2$ means the rolling reduction in the seventh stage.

Regarding the conversion value PE of the recrystallization suppression effect by a precipitate forming element, the austenite pinning effect and the solute drug effect become apparent when the value of Ti+1.3 Nb is 0.02 or more. Thus, in Equation 2, in a case where Ti+1.3 Nb<0.02 is satisfied, PE=0.01, and in a case where Ti+1.3 Nb≥0.02 is satisfied, PE=Ti+1.3 Nb−0.01.

Regarding the converted rolling reduction $F_1$* in one stage before the final stage, the effect of the rolling reduction $F_1$ in one stage before the final stage on the texture becomes apparent when the value of $F_1$ is 12 or more. Thus, in Equation 3, in a case where $F_1<12$ is satisfied, $F_1$*=1.0, and in a case where $F_1\geq 12$ is satisfied, $F_1$*=$F_1$−11.

Regarding the converted rolling reduction $F_2$* in the final stage, the effect of the rolling reduction $F_2$ in the final stage on the texture becomes apparent when the value of $F_2$ is 11.1 or more. Thus, in Equation 4, in a case where $F_2<11.1$ is satisfied, $F_2$*=0.1, and in a case where $F_2\geq 11.1$ is satisfied, $F_2$*=$F_2$−11.

Equation 1 shows preferable manufacturing conditions in finish rolling in which the rolling temperature $FT_2$ in the final stage is 930° C. or higher, and in a case where $FT_2$ is lower than 930° C., the value of the texture forming parameter ω is meaningless. That is, $FT_2$ is 930° C. or higher and ω is 100 or less.

(Finish Rolling Start Temperature is 1000° C. to 1150° C.)

When the finish rolling start temperature is lower than 1000° C., the recrystallization of the structure processed by rolling in the previous stage excluding the last two stages does not occur sufficiently, the texture of the sheet surface region is developed, and thus the texture of the surface region cannot be controlled to be within the above range. Therefore, the finish rolling start temperature is set to 1000° C. or higher. The finish rolling start temperature is preferably 1050° C. or higher. On the other hand, when the finish rolling start temperature is higher than 1150° C., the austenite grains become excessively coarse and the toughness is deteriorated. Thus, the finish rolling start temperature is set to 1150° C. or lower.

(Finish Rolling is Performed Under Condition that ω Calculated by Equation 1 is 100 or Less by Controlling each Condition at Last Two Stages of Rolling in Multi-Stage Finish Rolling)

In the manufacturing of the hot-rolled steel sheet according to the embodiment, the hot rolling conditions in the last two stages in the multi-stage finish rolling are important.

The rolling reductions $F_1$ and $F_2$ at the time of the last two stages of rolling used to calculate ω defined by Equation 1 are numerical values expressing a difference in sheet thickness before and after rolling at each stage divided by the sheet thickness before rolling as a percentage. The diameters $D_1$ and $D_2$ of the rolling rolls are measured at room temperature, and it is not necessary to consider the flatness during hot rolling. In addition, the sheet thicknesses $t_1$ and $t_2$ on the rolling inlet side, and the sheet thickness $t_f$ after finish rolling may be measured on the spot using radiation or the like or may be obtained by calculation from a rolling force in consideration of deformation resistance and the like. The sheet thickness $t_f$ after finish rolling may be the final sheet thickness of the steel sheet after the completion of hot rolling. Regarding the rolling start temperatures $FT_1$ and $FT_2$, the values measured by a thermometer such as a radiation-type thermometer between the finish rolling stands may be used.

The texture forming parameter ω is an index in consideration of the rolling strain introduced into the entire steel sheet in the last two stages of finish rolling, the shear strain introduced into the sheet surface region, and the recrystallization rate after rolling, and means the ease of forming a texture. When the last two stages of finish rolling are performed under the condition that the texture forming parameter ω is more than 100, the crystal orientation group consisting of {110}<110> to {110}<001> is developed in the surface region and the texture of the surface region cannot be controlled to be within the above range. Alternatively, the distribution of the pole density of the crystal orientation included in the crystal orientation group is uneven in the surface region, and thus the standard deviation of the pole density of the crystal orientation group cannot be controlled to be within the above range. Therefore, in the finish rolling step, the texture forming parameter ω is controlled to 100 or less.

In addition, in a case where the texture forming parameter ω is set to 60 or less, the amount of shear strain introduced into the sheet surface region is reduced and the recrystallization behavior in the central region of the sheet thickness is promoted. Thus, in addition to the texture of the sheet surface region, the pole density of the crystal orientation of {334}<263> in the central region of the sheet thickness is 7.0 or less, and the anisotropy in bending workability becomes small. Therefore, it is preferable that the texture forming parameter ω is set to 60 or less in the finish rolling step.

(Rolling Temperature FT1 in One Stage Before Final Stage is 960° C. to 1015° C.)

When the rolling temperature $FT_1$ in one stage before the final stage is lower than 960° C., the recrystallization of the structure worked by rolling does not sufficiently occur and the texture of the surface region cannot be controlled to be within the above range. Therefore, the rolling temperature $FT_1$ is set to 960° C. or higher. On the other hand, when the rolling temperature $FT_1$ is higher than 1015° C., the formation state and recrystallization behavior of the worked structure are changed due to coarsening of austenite grains or the like. Thus, the texture of the surface region cannot be controlled to be within the above range. Therefore, the rolling temperature $FT_1$ is set to 1015° C. or lower.

(Rolling Reduction $F_1$ in One Stage Before Final Stage is More Than 11% and 23% or Less)

When the rolling reduction $F_1$ in one stage before the final stage is 11% or less, the amount of strain introduced into the steel sheet by rolling is insufficient, recrystallization does not occur sufficiently, and thus, the texture of the surface region cannot be controlled to be within the above range. Therefore, the rolling reduction $F_1$ is set to more than 11%. On the other hand, when the rolling reduction $F_1$ is more than 23%, the lattice defect in the crystals is excessive and the recrystallization behavior is changed. Thus, the texture of the surface region cannot be controlled to be within the above range. Therefore, the rolling reduction $F_1$ is set to 23% or less.

The rolling reduction $F_1$ is calculated as follows.

$$F_1=(t_1-t_2)/t_1\times100$$

(Rolling Temperature $FT_2$ in Final Stage is 930° C. to 995° C.)

When the rolling temperature $FT_2$ in the final stage is lower than 930° C., the recrystallization rate of austenite is significantly reduced, the development of the crystal orientation group consisting of {110}<110> to {110}<001> in the surface region cannot be suppressed, and the texture of the surface region cannot be controlled to be within the above range. Therefore, the rolling temperature $FT_2$ is set to 930° C. or higher. On the other hand, when the rolling temperature $FT_2$ is higher than 995° C., the formation state of the worked structure and the recrystallization behavior are changed, and thus the texture of the surface region cannot be controlled to be within the above range. Therefore, the rolling temperature $FT_2$ is set to 995° C. or lower.

(Rolling Reduction $F_2$ of Final Stage is More Than 11% and 21% or Less)

When the rolling reduction $F_2$ of the final stage is 11% or less, the amount of strain introduced into the steel sheet by rolling is insufficient, recrystallization does not occur sufficiently, and thus the texture of the surface region cannot be controlled to be within the above range. Therefore, the rolling reduction $F_2$ is set to more than 11%. On the other hand, when the rolling reduction $F_2$ is more than 21%, the lattice defect in the crystals is excessive, the recrystallization behavior is changed, and thus the texture of the surface region cannot be controlled to be within the above range. Therefore, the rolling reduction $F_2$ is set to 21% or less.

The rolling reduction $F_2$ is calculated as follows.

$$F_2=(t_2-t_f)/t_2\times100$$

In the finish rolling step, each of the above conditions is controlled simultaneously and inseparably. Each of the above-mentioned conditions does not have to satisfy only one of the above-mentioned conditions, and when all of the above-mentioned conditions are satisfied at the same time, the texture of the surface region can be controlled to be within the above-mentioned range.

The hot-rolled steel sheet after finish rolling is cooled and coiled. In the hot-rolled steel sheet according to the embodiment, excellent bending workability is achieved in both L-axis bending and C-axis bending by controlling the texture rather than the base structure (constituent phase of the steel structure). Therefore, the manufacturing conditions are not particularly limited in the cooling step and the coiling step. Therefore, the cooling step and the coiling step after the multi-stage finish rolling may be performed by an ordinary method.

The constituent phase of the steel sheet during finish rolling is mainly austenite, and the texture of austenite is controlled by the finish rolling described above.

The high temperature stable phase such as austenite undergoes a phase transformation to a low temperature stable phase such as bainite at the time of cooling and coiling after finish rolling. Due to this phase transformation, the crystal orientation may be changed and the texture of the steel sheet after cooling may be changed. However, with respect to the hot-rolled steel sheet according to the embodiment, the above-mentioned crystal orientation controlled in the surface region is not significantly affected by cooling and coiling after finish rolling. That is, when the texture is controlled to austenite at the time of finish rolling, even in a case where the phase is transformed into a low temperature stable phase such as bainite at the time of the following cooling and coiling, this low temperature stable phase satisfies the definition of the above-mentioned texture in the surface region. The same applies to the texture of the central region of sheet thickness.

In addition, the hot-rolled steel sheet according to the embodiment may be pickled as required after cooling. Even when this pickling treatment is performed, the texture of the surface region does not change. For example, the pickling treatment may be carried out with hydrochloric acid having a concentration of 3 to 10% at a temperature of 85° C. to 98° C. for 20 seconds to 100 seconds.

In addition, the hot-rolled steel sheet according to the embodiment may be subjected to skin pass rolling as required after cooling. In this skin pass rolling, the rolling reduction may be set so that the texture of the surface region is not changed. The skin pass rolling has the effect of preventing stretcher strain generated at the time of work forming and correcting shape.

EXAMPLE 1

Hereinafter, the effects of an aspect of the present invention are described in detail with reference to the following examples. However, the condition in the examples is an example condition employed to confirm the operability and the effects of the present invention, so that the present invention is not limited to the example condition. The present invention can employ various types of conditions as long as the conditions do not depart from the scope of the present invention and can achieve the object of the present invention.

A steel having a predetermined chemical composition was cast, and after casting, the slab was cooled as it is or once cooled to room temperature, then reheated, and heated to a temperature range of 1200° C. to 1300° C. Then, the slab was subjected to rough rolling at a temperature of 1100° C. or higher until the desired sheet thickness of the rough-rolled sheet was obtained, and thus a rough-rolled sheet was prepared. The rough-rolled sheet was subjected to multi-stage finish rolling including seven stages in total. The steel sheet after finish rolling was cooled and coiled to prepare a hot-rolled steel sheet.

Tables 1 and 2 show the chemical composition of the hot-rolled steel sheet. Regarding the chemical composition, the values marked with "<" in the table indicate that the values are equal to or less than the detection limit of the measuring device and these elements are not intentionally added to the steel.

In addition, in the finish rolling step, finish rolling was started from the temperatures shown in Tables 3 to 6, and rolling was performed to the sheet thickness $t_1$ at the start time of rolling in one stage before the final stage shown in Tables 3 to 6 by a total of five stages of rolling excluding the last two stages of rolling from the start of rolling. Then, the last two stages of rolling were performed under the conditions shown in Tables 3 to 10. After the completion of finish rolling, cooling and coiling were performed with each cooling pattern shown below to obtain a hot-rolled steel sheet having a sheet thickness $t_f$ shown in Tables 3 to 6. The final sheet thickness of the steel sheet after the completion of hot rolling was defined as the sheet thickness $t_f$ after finish rolling.

(Cooling Pattern B: Bainite Pattern)

In this pattern, after the finish rolling was completed, the steel sheet was cooled to a coiling temperature of 450° C. to 550° C. at an average cooling rate of 20° C./sec or higher, and then coiled into a coil shape.

(Cooling Pattern F+B: Ferrite-Bainite Pattern)

In this pattern, after the finish rolling is completed, the steel sheet was cooled to a cooling stop temperature range of 600° C. to 750° C. at an average cooling rate of 20° C./sec or higher, the cooling is stopped within the cooling stop temperature range, and the steel sheet was retained for 2 to 4 seconds. Then, the steel sheet was further coiled into a coil shape at an average cooling rate of 20° C./sec or higher and a coiling temperature of 550° C. or lower. The cooling stop temperature and the retention time were set with reference to the Ar3 temperature below.

$$Ar3(^\circ C.)=870-390C+24Si-70Mn-50Ni-5Cr-20Cu+80Mo$$

(Cooling Pattern Ms: Martensite Pattern)

In this pattern, after the finish rolling was completed, the steel sheet was cooled to a coiling temperature of 100° C. or lower at an average cooling rate of 20° C./sec or higher, and then coiled into a coil shape.

In addition, in test materials Nos. 1 to 142, rough rolling was performed with a total rolling reduction of 40% or more in a range of 1200° C. to 1100° C., and finish rolling was performed such that a total rolling reduction of the five stages other than the last two stages in multi-stage finish rolling was 50% or more. However, each total rolling reduction is a numerical value expressed as a percentage calculated based on the sheet thickness at the time of the start of rough rolling and at the time of the start of finish rolling and the sheet thickness at the time of the completion of rough rolling and at the time of the completion of the fifth finish rolling stage.

Tables 1 and 2 show the chemical composition, Tables 3 to 10 show each manufacturing condition, and Tables 11 to 14 show each manufacturing result of the prepared hot-rolled steel sheets. In the column of "Cooling and coiling pattern" in Tables 7 to 10, "B" indicates a bainite pattern, "F+B" indicates a ferrite-bainite pattern, and "Ms" indicates a martensite pattern. Further, in the column of "Texture" in Tables 11 to 14, "A crystal orientation group" indicates a crystal orientation group consisting of {110}<110> to {110}<001>, and "B crystal orientation" indicates a crystal orientation of {334}<263>. In addition, each symbol used in the table corresponds to the symbol described above.

Regarding the tensile strength, a tensile test was performed according to JIS Z 2241 (2011) using a JIS No. 5 test piece collected from a ¼ position in the width direction of the hot-rolled steel sheet so that the direction perpendicular to the rolling direction (C direction) is the longitudinal direction, and the maximum tensile strength TS and butt elongation (total elongation) EL were obtained.

In a bending test, a test piece cut out in a strip shape of 100 mm×30 mm from a ½ position in the width direction of the hot-rolled steel sheet was used. The bending test for both bending (L-axis bending) where the bending ridge was parallel to the rolling direction (L direction) and bending (C-axis bending) where the bending ridge was parallel to the direction perpendicular to the rolling direction (C direction) was performed according to JIS Z 2248 (2014) (V block 90° bending test) to obtain the minimum bend radius which does not cause cracks. However, the presence or absence of cracks was confirmed by mirror-polishing a cross section obtained by cutting the test piece after the V block 90° bending test on the surface parallel to the bending direction and perpendicular to the sheet surface and then observing cracks on the outside of the bending of the test piece with an optical microscope. In a case where the length of the observed cracks was longer than 50 μm, it was determined that there were cracks.

The numbers underlined in Tables 1 to 14 indicate that the numbers are out of the scope of the present invention.

In Tables 1 to 14, the test material Nos. described as "Invention Example" are steel sheets satisfying all of the conditions of the present invention.

In Invention examples, the steel composition is satisfied, the average of pole densities of the crystal orientation group consisting of {110}<110> to {110}<001> in the surface region is 0.5 or more and 3.0 or less, the standard deviation of the pole density of the crystal orientation group is 0.2 or more and 2.0 or less, and the tensile strength is 780 MPa or more. Therefore, a hot-rolled steel sheet having excellent bendability and small anisotropy in bending workability in which in both L-axis bending and C-axis bending, Rm/t, which is a value obtained by dividing the minimum bend radius by the sheet thickness, is 2.0 or less, can be obtained.

On the other hand, in Tables 1 to 14, the test material Nos. described as "Comparative Example" are steel sheets not satisfying at least one of the steel composition, the texture of the surface region, or the tensile strength.

In test material No. 5, since the Mn content was out of the control range, the tensile strength was not sufficient.

In test material No. 8, since the Mn content was out of the control range, the bendability and the anisotropy in bending workability were not sufficient.

In test material No. 9, since the C content was out of the control range, the tensile strength was not sufficient.

In test material No. 15, since the Ti content and the texture forming parameter ω were out of the control range, the texture was not satisfied and the bendability and the anisotropy in bending workability were not sufficient.

In test material No. 19, since the Nb content and the texture forming parameter ω were out of the control range, the texture was not satisfied and the bendability and the anisotropy in bending workability were not sufficient.

In test material No. 31, since the finish rolling conditions $FT_1$ and $FT_2$ were out of the control range, the texture was not satisfied and the bendability and the anisotropy in bending workability were not sufficient.

In test material No. 33, since the finish rolling conditions $FT_1$ and $FT_2$ were out of the control range, the texture was not satisfied and the bendability and the anisotropy in bending workability were not sufficient.

In test material No. 35, since the texture forming parameter ω was out of the control range, the texture was not satisfied and the bendability and the anisotropy in bending workability were not sufficient.

In test material No. 48, since the Ti content and the texture forming parameter ω were out of the control range, the texture was not satisfied and the bendability and the anisotropy in bending workability were not sufficient.

In test material No. 51, since the Nb content and the texture forming parameter ω were out of the control range, the texture was not satisfied and the bendability and the anisotropy in bending workability were not sufficient.

In test material No. 55, since the finish rolling condition $FT_1$ and the texture forming parameter ω were out of the control range, the texture was not satisfied and the bendability and the anisotropy in bending workability were not sufficient.

In test material No. 58, since the finish rolling condition $FT_1$ and the texture forming parameter ω were out of the control range, the texture was not satisfied and the bendability and the anisotropy in bending workability were not sufficient.

In test material No. 63, since the texture forming parameter ω was out of the control range, the texture was not satisfied and the bendability and the anisotropy in bending workability were not sufficient.

In test material No. 66, since the texture forming parameter ω was out of the control range, the texture was not satisfied and the bendability and the anisotropy in bending workability were not sufficient.

In test material No. 71, since the texture forming parameter ω was out of the control range, the texture was not satisfied and the bendability and the anisotropy in bending workability were not sufficient.

In test material No. 74, since the finish rolling condition $F_1$ and the texture forming parameter ω were out of the control range, the texture was not satisfied and the bendability and the anisotropy in bending workability were not sufficient.

In test material No. 79, since the texture forming parameter ω was out of the control range, the texture was not satisfied and the bendability and the anisotropy in bending workability were not sufficient.

In test material No. 82, since the texture forming parameter ω was out of the control range, the texture was not satisfied and the bendability and the anisotropy in bending workability were not sufficient.

In test material No. 87, since the texture forming parameter ω was out of the control range, the texture was not satisfied and the bendability and the anisotropy in bending workability were not sufficient.

In test material No. 90, since the texture forming parameter ω was out of the control range, the texture was not satisfied and the bendability and the anisotropy in bending workability were not sufficient.

In test material No. 95, since the texture forming parameter ω was out of the control range, the texture was not satisfied and the bendability and the anisotropy in bending workability were not sufficient.

In test material No. 98, since the texture forming parameter ω was out of the control range, the texture was not satisfied and the bendability and the anisotropy in bending workability were not sufficient.

In test material No. 103, since the finish rolling start temperature and the finish rolling conditions $F_1$ were out of the control range, the texture was not satisfied and the bendability and the anisotropy in bending workability were not sufficient.

In test material No. 110, since the thickness of the rough-rolled sheet was out of the control range, the texture was not satisfied and the bendability and the anisotropy in bending workability were not sufficient.

In test material No. 113, since the thickness of the rough-rolled sheet was out of the control range, the texture was not satisfied and the bendability and the anisotropy in bending workability were not sufficient.

In test material No. 114, since the finish rolling condition $FT_1$ was out of the control range, the texture was not satisfied and the bendability and the anisotropy in bending workability were not sufficient.

In test material No. 115, since the finish rolling condition $FT_2$ was out of the control range, the texture was not satisfied and the bendability and the anisotropy in bending workability were not sufficient.

In test material No. 116, since the finish rolling condition $FT_2$ was out of the control range, the texture was not satisfied and the bendability and the anisotropy in bending workability were not sufficient.

In test material No. 117, since the finish rolling condition $F_1$ was out of the control range, the texture was not satisfied and the bendability and the anisotropy in bending workability were not sufficient.

In test material No. 118, since the finish rolling condition $F_2$ was out of the control range, the texture was not satisfied and the bendability and the anisotropy in bending workability were not sufficient.

In test material No. 119, since the finish rolling condition $F_2$ was out of the control range, the texture was not satisfied and the bendability and the anisotropy in bending workability were not sufficient.

In test material No. 120, since the finish rolling start temperature was out of the control range, the texture was not satisfied and the bendability and the anisotropy in bending workability were not sufficient.

In test material No. 121, since the Si content, the thickness of the rough-rolled sheet, the finish rolling start temperature, and the finish rolling condition $F_1$ were out of the control range, the texture was not satisfied and the bendability and the anisotropy in bending workability were not sufficient.

In test material No. 122, since the finish rolling conditions $F_1$ and $F_2$ were out of the control range, the texture was not satisfied and the bendability and the anisotropy in bending workability were not sufficient.

In test material No. 123, since the finish rolling conditions $FT_1$ and $FT_2$ were out of the control range, the texture was not satisfied and the bendability and the anisotropy in bending workability were not sufficient.

In test material No. 124, since the thickness of the rough-rolled sheet, the finish rolling start temperature, and the finish rolling condition $F_1$, and $F_2$ were out of the control range, the texture was not satisfied and the bendability and the anisotropy in bending workability were not sufficient.

In Examples in which the rolling temperature $FT_2$ in the final stage was lower than 930° C., the value of the texture forming parameter ω is meaningless, and thus ω and the like are left blank in the table.

TABLE 1

| STEEL | CHEMICAL COMPOSITION(UNIT: MASS %, BALANCE CONSISTING OF FE AND IMPURITIES) | | | | | | | | | |
|---|---|---|---|---|---|---|---|---|---|---|
| TYPE | 0 | Si | Mn | sol.Al | Ti | Nb | P | S | N | OTHER |
| A | 0.07 | 0.90 | 2.20 | 0.050 | 0.120 | 0.018 | 0.010 | 0.001 | 0.003 | Ca: 0.002 |
| B | 0.09 | 0.70 | 1.90 | 0.100 | 0.130 | 0.020 | 0.010 | 0.001 | 0.002 | |
| C | 0.07 | 0.08 | 2.10 | 0.100 | 0.100 | 0.030 | 0.008 | 0.001 | 0.003 | |
| D | 0.10 | 2.10 | 2.60 | 0.025 | 0.110 | 0.020 | 0.010 | 0.002 | 0.002 | B: 0.001 |
| E | 0.06 | 1.00 | 0.80 | 0.029 | 0.100 | 0.010 | 0.010 | 0.001 | 0.003 | |

TABLE 1-continued

| STEEL | CHEMICAL COMPOSITION(UNIT: MASS %, BALANCE CONSISTING OF FE AND IMPURITIES) | | | | | | | | | |
|---|---|---|---|---|---|---|---|---|---|---|
| TYPE | 0 | Si | Mn | sol.Al | Ti | Nb | P | S | N | OTHER |
| F | 0.08 | 1.23 | 1.10 | 0.020 | 0.140 | 0.010 | 0.012 | 0.003 | 0.003 | |
| G | 0.08 | 1.40 | 3.30 | 0.020 | 0.080 | 0.007 | 0.010 | 0.001 | 0.002 | B: 0.002 |
| H | 0.06 | 1.30 | 4.50 | 0.030 | 0.130 | 0.010 | 0.012 | 0.001 | 0.003 | |
| I | 0.01 | 0.90 | 1.10 | 0.028 | 0.015 | 0.020 | 0.010 | 0.001 | 0.003 | |
| J | 0.05 | 1.50 | 1.24 | 0.040 | 0.090 | 0.020 | 0.010 | 0.001 | 0.002 | |
| K | 0.21 | 1.20 | 2.00 | 0.030 | 0.030 | 0.010 | 0.010 | 0.002 | 0.003 | |
| L | 0.07 | 1.30 | 2.50 | 0.025 | <0.001 | 0.010 | 0.011 | 0.001 | 0.002 | |
| M | 0.06 | 1.60 | 2.30 | 0.041 | 0.050 | 0.030 | 0.009 | 0.002 | 0.002 | |
| N | 0.09 | 1.20 | 1.80 | 0.041 | 0.170 | 0.005 | 0.009 | 0.002 | 0.002 | |
| O | 0.07 | 0.80 | 1.45 | 0.010 | 0.300 | 0.010 | 0.012 | 0.002 | 0.003 | |
| P | 0.06 | 1.00 | 1.50 | 0.033 | 0.090 | <0.001 | 0.010 | 0.001 | 0.003 | |
| Q | 0.10 | 1.30 | 1.80 | 0.031 | 0.080 | 0.008 | 0.010 | 0.003 | 0.003 | |
| R | 0.11 | 1.10 | 1.21 | 0.029 | 0.100 | 0.070 | 0.011 | 0.002 | 0.003 | |
| S | 0.05 | 1.10 | 1.40 | 0.025 | 0.030 | 0.250 | 0.010 | 0.001 | 0.002 | |
| T | 0.06 | 0.60 | 2.20 | 0.030 | <0.001 | <0.001 | 0.010 | 0.002 | 0.003 | |
| U | 0.06 | 0.70 | 1.80 | 0.030 | 0.100 | 0.007 | 0.011 | 0.001 | 0.003 | V: 0.01 |
| V | 0.08 | 1.89 | 2.21 | 0.025 | 0.090 | 0.010 | 0.010 | 0.001 | 0.003 | Cr: 0.4 |
| W | 0.12 | 1.30 | 1.80 | 0.020 | 0.090 | 0.008 | 0.012 | 0.001 | 0.003 | Mo: 0.01 |
| X | 0.06 | 1.10 | 1.60 | 0.020 | 0.110 | 0.012 | 0.010 | 0.001 | 0.002 | Cu: 0.01 |
| Y | 0.06 | 1.02 | 2.01 | 0.030 | 0.100 | 0.020 | 0.010 | 0.001 | 0.003 | Co: 0.1 |
| Z | 0.06 | 0.90 | 1.88 | 0.029 | 0.110 | 0.007 | 0.010 | 0.001 | 0.003 | W: 0.01 |
| AA | 0.07 | 1.80 | 1.10 | 0.020 | 0.110 | 0.010 | 0.012 | 0.003 | 0.003 | Ni: 0.8 |
| AB | 0.11 | 1.20 | 2.70 | 0.021 | 0.100 | 0.030 | 0.013 | 0.001 | 0.002 | Mg: 0.002 |

TABLE 2

| STEEL | CHEMICAL COMPOSITION(UNIT: MASS %, BALANCE CONSISTING OF FE AND IMPURITIES) | | | | | | | | | |
|---|---|---|---|---|---|---|---|---|---|---|
| TYPE | C | Si | Mn | sol.Al | Ti | Nb | P | s | N | OTHER |
| AC | 0.08 | 0.87 | 1.30 | 0.030 | 0.080 | 0.021 | 0.011 | 0.002 | 0.003 | REM: 0.001 |
| AD | 0.09 | 1.43 | 2.10 | 0.130 | 0.120 | 0.031 | 0.014 | 0.001 | 0.002 | Zr: 0.002 |
| AE | 0.05 | 0.90 | 1.60 | 0.030 | 0.030 | 0.040 | 0.010 | 0.003 | 0.003 | B: 0.002 |
| AF | 0.06 | 1.10 | 1.20 | 0.027 | 0.090 | 0.015 | 0.020 | 0.003 | 0.003 | |
| AG | 0.13 | 0.12 | 2.80 | 0.030 | 0.190 | 0.100 | 0.015 | 0.005 | 0.003 | B: 0.0012 |
| AH | 0.06 | 0.049 | 2.45 | 0.045 | 0.021 | <0.001 | 0.013 | 0.003 | 0.004 | B: 0.001 |
| AI | 0.04 | 1.20 | 1.00 | 0.120 | 0.110 | <0.001 | 0.015 | 0.003 | 0.004 | |
| AJ | 0.15 | 0.80 | 2.00 | 0.400 | 0.070 | 0.035 | 0.014 | 0.003 | 0.004 | Cr: 0.3 |
| AK | 0.19 | 1.28 | 2.46 | 0.300 | <0.001 | <0.001 | 0.017 | 0.001 | 0.004 | |
| AL | 0.08 | 0.80 | 1.90 | 0.100 | 0.130 | 0.001 | 0.008 | 0.001 | 0.003 | B: 0.002, Cr: 0.40 |
| AM | 0.12 | 1.40 | 1.50 | 0.040 | 0.100 | 0.002 | 0.015 | 0.002 | 0.003 | B: 0.002, Cr: 0.25, Mo: 0.2 |
| AN | 0.10 | 0.80 | 1.40 | 0.030 | 0.080 | 0.002 | 0.011 | 0.002 | 0.002 | B: 0.002, Cr: 0.25, Mo: 0.2, V: 0.01 |
| AO | 0.05 | 1.40 | 2.00 | 0.050 | 0.115 | 0.003 | 0.012 | 0.002 | 0.003 | Cr: 0.6, Mo: 0.3 |
| AP | 0.08 | 1.20 | 1.90 | 0.034 | 0.090 | 0.002 | 0.011 | 0.001 | 0.003 | Cr: 0.35, V: 0.03 |
| AQ | 0.07 | 1.10 | 1.78 | 0.150 | 0.100 | 0.001 | 0.012 | 0.002 | 0.003 | Cr: 0.4, Mo: 0.15, V: 0.03 |
| AR | 0.08 | 1.20 | 2.10 | 0.250 | 0.110 | 0.002 | 0.011 | 0.001 | 0.004 | B: 0.002, Cr: 0.2, V: 0.01 |
| AS | 0.12 | 1.10 | 2.10 | 0.030 | 0.100 | 0.020 | 0.013 | 0.001 | 0.002 | B: 0.001, Mo: 0.15, V: 0.02 |
| AT | 0.06 | 1.00 | 1.50 | 0.100 | 0.150 | 0.010 | 0.008 | 0.001 | 0.003 | B: 0.002, Mo: 0.15 |
| AU | 0.14 | 1.10 | 1.60 | 0.050 | 0.110 | 0.024 | 0.013 | 0.001 | 0.003 | B: 0.002, V: 0.02 |
| AV | 0.07 | 1.50 | 1.70 | 0.030 | 0.120 | 0.010 | 0.014 | 0.002 | 0.003 | Mo: 0.34, V: 0.02 |
| AW | 0.11 | 0.70 | 1.30 | 0.080 | 0.025 | <0.001 | 0.015 | 0.002 | 0.003 | Cn: 0.35, Mo: 0.4, V: 0.01, Ca: 0.001 |
| AX | 0.08 | 0.89 | 1.20 | 0.030 | 0.090 | 0.002 | 0.017 | 0.001 | 0.003 | Cr: 0.4, Mo: 0.15, W: 0.03 |
| AY | 0.07 | 1.02 | 1.30 | 0.025 | 0.080 | 0.001 | 0.012 | 0.001 | 0.003 | Cr: 0.35, W: 0.03 |
| AZ | 0.06 | 0.70 | 1.82 | 0.003 | 0.120 | 0.002 | 0.010 | 0.001 | 0.003 | Cn: 0.4, Ni: 0.2 |
| BA | 0.07 | 1.00 | 1.68 | 0.005 | 0.100 | 0.001 | 0.012 | 0.001 | 0.003 | Cr: 0.4, Ni: 0.15, V: 0.1 |
| BB | 0.08 | 0.09 | 2.00 | 0.065 | 0.090 | 0.002 | 0.013 | 0.001 | 0.003 | B: 0.001, Cr: 0.4, Ni: 0.2 |
| BC | 0.07 | 0.81 | 2.10 | 0.180 | 0.112 | 0.021 | 0.009 | 0.002 | 0.003 | Ni: 0.06, Ca: 0.002 |

TABLE 3

| TEST MATERIAL No. | TYPE STEL | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (MASS %) | Nb (MASS %) | Ti + 1.3 Nb (MASS %) | FT1 (° C.) | FT2 (° C.) | t1 (mm) | D1 (mm) |
|---|---|---|---|---|---|---|---|---|---|---|---|
| 1 | A | 2.9 | 40 | 1080 | 0.120 | 0.018 | 0.143 | 987 | 969 | 4.15 | 719 |
| 2 | B | 2.9 | 40 | 1076 | 0.130 | 0.020 | 0.156 | 988 | 968 | 4.00 | 719 |
| 3 | C | 2.9 | 40 | 1060 | 0.100 | 0.030 | 0.139 | 988 | 965 | 4.03 | 719 |
| 4 | D | 2.9 | 40 | 1049 | 0.110 | 0.020 | 0.136 | 993 | 966 | 4.31 | 719 |
| 5 | E | 2.9 | 40 | 1052 | 0.100 | 0.010 | 0.113 | 987 | 972 | 4.36 | 719 |
| 6 | F | 2.9 | 40 | 1056 | 0.140 | 0.010 | 0.153 | 995 | 970 | 4.28 | 719 |
| 7 | G | 2.9 | 40 | 1068 | 0.080 | 0.007 | 0.089 | 989 | 967 | 4.34 | 719 |
| 8 | H | 2.9 | 40 | 1052 | 0.130 | 0.010 | 0.143 | 991 | 968 | 4.31 | 719 |
| 9 | I | 2.9 | 40 | 1074 | 0.015 | 0.020 | 0.041 | 987 | 969 | 3.97 | 719 |
| 10 | J | 2.9 | 40 | 1063 | 0.090 | 0.020 | 0.116 | 987 | 964 | 3.94 | 719 |
| 11 | K | 2.9 | 40 | 1076 | 0.030 | 0.010 | 0.043 | 994 | 970 | 4.27 | 719 |
| 12 | L | 2.9 | 40 | 1049 | <0.001 | 0.010 | 0.013 | 990 | 969 | 4.16 | 719 |
| 13 | M | 2.9 | 40 | 1073 | 0.050 | 0.030 | 0.089 | 985 | 972 | 4.39 | 719 |
| 14 | N | 2.9 | 40 | 1067 | 0.170 | 0.005 | 0.177 | 989 | 964 | 3.90 | 719 |
| 15 | O | 2.9 | 40 | 1064 | 0.300 | 0.010 | 0.313 | 988 | 970 | 4.15 | 719 |
| 16 | P | 2.9 | 40 | 1062 | 0.090 | <0.001 | 0.090 | 990 | 973 | 4.09 | 719 |
| 17 | Q | 2.9 | 40 | 1068 | 0.080 | 0.008 | 0.090 | 988 | 965 | 4.35 | 719 |
| 18 | R | 2.9 | 40 | 1065 | 0.100 | 0.070 | 0.191 | 994 | 966 | 4.25 | 719 |
| 19 | S | 2.9 | 40 | 1048 | 0.030 | 0.250 | 0.355 | 990 | 966 | 4.06 | 719 |
| 20 | T | 2.9 | 40 | 1068 | <0.001 | <0.001 | 0 | 989 | 966 | 4.13 | 719 |
| 21 | U | 2.9 | 40 | 1048 | 0.100 | 0.007 | 0.109 | 995 | 964 | 4.11 | 719 |
| 22 | V | 2.9 | 40 | 1052 | 0.090 | 0.010 | 0.103 | 987 | 968 | 4.29 | 719 |
| 23 | W | 2.9 | 40 | 1066 | 0.090 | 0.008 | 0.100 | 987 | 967 | 4.19 | 719 |
| 24 | X | 2.9 | 40 | 1047 | 0.110 | 0.012 | 0.126 | 992 | 970 | 4.27 | 719 |
| 25 | Y | 2.9 | 40 | 1083 | 0.100 | 0.020 | 0.126 | 991 | 968 | 3.94 | 719 |
| 26 | Z | 2.9 | 40 | 1066 | 0.110 | 0.007 | 0.119 | 993 | 969 | 4.09 | 719 |
| 27 | AA | 2.9 | 40 | 1045 | 0.110 | 0.010 | 0.123 | 989 | 964 | 4.27 | 719 |
| 28 | AB | 2.9 | 40 | 1077 | 0.100 | 0.030 | 0.139 | 987 | 970 | 4.40 | 719 |
| 29 | AC | 2.9 | 40 | 1064 | 0.080 | 0.021 | 0.107 | 994 | 972 | 4.24 | 719 |
| 30 | AD | 2.9 | 40 | 1050 | 0.120 | 0.031 | 0.160 | 995 | 969 | 4.17 | 719 |
| 31 | AE | 2.9 | 40 | 1081 | 0.030 | 0.040 | 0.082 | 911 | 880 | 4.10 | 719 |
| 32 | AE | 2.9 | 40 | 1073 | 0.030 | 0.040 | 0.082 | 986 | 964 | 4.21 | 719 |
| 33 | AF | 2.9 | 40 | 1059 | 0.090 | 0.015 | 0.110 | 935 | 910 | 4.01 | 719 |
| 34 | AF | 2.9 | 40 | 1052 | 0.090 | 0.015 | 0.110 | 993 | 971 | 4.28 | 719 |
| 35 | AG | 3.6 | 40 | 1053 | 0.190 | 0.100 | 0.320 | 965 | 937 | 4.80 | 719 |
| 36 | AG | 3.6 | 40 | 1059 | 0.190 | 0.100 | 0.320 | 1015 | 993 | 5.16 | 719 |

TABLE 4

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (MASS %) | Nb (MASS %) | Ti + 1.3 Nb (MASS %) | FT1 (° C.) | FT2 (° C.) | t1 (mm) | D1 (mm) |
|---|---|---|---|---|---|---|---|---|---|---|---|
| 37 | A | 2.0 | 40 | 1054 | 0.120 | 0.018 | 0.143 | 993 | 972 | 2.95 | 719 |
| 38 | A | 2.3 | 40 | 1051 | 0.120 | 0.018 | 0.143 | 992 | 970 | 3.09 | 719 |
| 39 | A | 3.6 | 40 | 1052 | 0.120 | 0.018 | 0.143 | 986 | 970 | 5.23 | 719 |
| 40 | A | 4.0 | 40 | 1048 | 0.120 | 0.018 | 0.143 | 993 | 968 | 5.89 | 719 |
| 41 | A | 5.0 | 40 | 1085 | 0.120 | 0.018 | 0.143 | 989 | 969 | 7.35 | 719 |
| 42 | A | 2.9 | 40 | 1076 | 0.120 | 0.018 | 0.143 | 996 | 984 | 4.26 | 760 |
| 43 | A | 2.9 | 40 | 1064 | 0.120 | 0.018 | 0.143 | 966 | 960 | 4.60 | 760 |
| 44 | A | 3.3 | 40 | 1072 | 0.120 | 0.018 | 0.143 | 996 | 985 | 5.03 | 760 |
| 45 | A | 3.3 | 40 | 1079 | 0.120 | 0.018 | 0.143 | 971 | 956 | 4.74 | 760 |
| 46 | A | 2.9 | 40 | 1055 | 0.120 | 0.018 | 0.143 | 998 | 993 | 4.04 | 760 |
| 47 | A | 2.9 | 40 | 1059 | 0.120 | 0.018 | 0.143 | 961 | 951 | 4.32 | 760 |
| 48 | O | 2.3 | 40 | 1069 | 0.300 | 0.010 | 0.313 | 993 | 966 | 3.17 | 732 |
| 49 | M | 2.3 | 40 | 1063 | 0.050 | 0.030 | 0.089 | 986 | 963 | 3.26 | 732 |
| 50 | N | 2.3 | 40 | 1074 | 0.170 | 0.005 | 0.177 | 994 | 971 | 3.21 | 732 |
| 51 | S | 2.3 | 40 | 1075 | 0.030 | 0.250 | 0.355 | 985 | 966 | 3.30 | 732 |
| 52 | R | 2.3 | 40 | 1059 | 0.100 | 0.070 | 0.191 | 995 | 964 | 3.30 | 732 |
| 53 | Q | 2.3 | 40 | 1084 | 0.080 | 0.008 | 0.090 | 993 | 969 | 3.45 | 732 |

TABLE 4-continued

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (MASS %) | Nb (MASS %) | Ti + 1.3 Nb (MASS %) | FT1 (° C.) | FT2 (° C.) | t1 (mm) | D1 (mm) |
|---|---|---|---|---|---|---|---|---|---|---|---|
| 54 | T | 2.3 | 40 | 1076 | <0.001 | <0.001 | 0 | 993 | 965 | 3.08 | 732 |
| 55 | B | 2.3 | 40 | 1081 | 0.130 | 0.020 | 0.156 | 951 | 944 | 3.20 | 732 |
| 56 | B | 2.3 | 40 | 1079 | 0.130 | 0.020 | 0.156 | 963 | 961 | 3.50 | 732 |
| 57 | B | 2.3 | 40 | 1067 | 0.130 | 0.020 | 0.156 | 968 | 964 | 3.42 | 732 |
| 58 | B | 4.0 | 40 | 1075 | 0.130 | 0.020 | 0.156 | 946 | 942 | 6.10 | 719 |
| 59 | B | 4.0 | 40 | 1062 | 0.130 | 0.020 | 0.156 | 961 | 955 | 6.19 | 719 |
| 60 | B | 4.0 | 40 | 1049 | 0.130 | 0.020 | 0.156 | 973 | 966 | 5.96 | 719 |
| 61 | T | 4.0 | 40 | 1083 | <0.001 | <0.001 | 0 | 961 | 938 | 5.80 | 719 |
| 62 | T | 4.0 | 40 | 1051 | <0.001 | <0.001 | 0 | 971 | 951 | 5.97 | 719 |
| 63 | B | 2.3 | 40 | 1051 | 0.130 | 0.020 | 0.156 | 988 | 941 | 3.11 | 732 |
| 64 | B | 2.3 | 40 | 1050 | 0.130 | 0.020 | 0.156 | 991 | 954 | 3.15 | 732 |
| 65 | B | 2.3 | 40 | 1071 | 0.130 | 0.020 | 0.156 | 986 | 962 | 3.08 | 732 |
| 66 | B | 4.0 | 40 | 1072 | 0.130 | 0.020 | 0.156 | 994 | 941 | 5.82 | 719 |
| 67 | B | 4.0 | 40 | 1062 | 0.130 | 0.020 | 0.156 | 988 | 952 | 6.15 | 719 |
| 68 | B | 4.0 | 40 | 1057 | 0.130 | 0.020 | 0.156 | 990 | 960 | 5.85 | 719 |
| 69 | T | 4.0 | 40 | 1083 | <0.001 | <0.001 | 0 | 993 | 950 | 6.02 | 719 |
| 70 | T | 4.0 | 40 | 1052 | <0.001 | <0.001 | 0 | 987 | 959 | 5.78 | 719 |
| 71 | B | 2.3 | 40 | 1046 | 0.130 | 0.020 | 0.156 | 993 | 968 | 3.12 | 1500 |
| 72 | B | 2.3 | 40 | 1045 | 0.130 | 0.020 | 0.156 | 987 | 971 | 3.01 | 800 |

TABLE 5

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (MASS %) | Nb (MASS %) | Ti + 1.3 Nb (MASS %) | FT1 (° C.) | FT2 (° C.) | t1 (mm) | D1 (mm) |
|---|---|---|---|---|---|---|---|---|---|---|---|
| 73 | B | 2.3 | 40 | 1067 | 0.130 | 0.020 | 0.156 | 998 | 970 | 3.00 | 700 |
| 74 | B | 4.0 | 40 | 1048 | 0.130 | 0.020 | 0.156 | 978 | 955 | 5.55 | 1500 |
| 75 | B | 4.0 | 40 | 1062 | 0.130 | 0.020 | 0.156 | 985 | 971 | 5.83 | 800 |
| 76 | B | 4.0 | 40 | 1077 | 0.130 | 0.020 | 0.156 | 990 | 968 | 5.95 | 700 |
| 77 | T | 4.0 | 40 | 1083 | <0.001 | <0.001 | 0 | 990 | 963 | 5.70 | 800 |
| 78 | T | 4.0 | 40 | 1076 | <0.001 | <0.001 | 0 | 988 | 967 | 5.70 | 700 |
| 79 | B | 2.3 | 40 | 1064 | 0.130 | 0.020 | 0.156 | 991 | 972 | 3.07 | 732 |
| 80 | B | 2.3 | 40 | 1066 | 0.130 | 0.020 | 0.156 | 988 | 973 | 3.15 | 732 |
| 81 | B | 2.3 | 40 | 1074 | 0.130 | 0.020 | 0.156 | 987 | 973 | 3.19 | 732 |
| 82 | B | 4.0 | 40 | 1057 | 0.130 | 0.020 | 0.156 | 993 | 965 | 5.68 | 719 |
| 83 | B | 4.0 | 40 | 1061 | 0.130 | 0.020 | 0.156 | 985 | 964 | 5.87 | 719 |
| 84 | B | 4.0 | 40 | 1047 | 0.130 | 0.020 | 0.156 | 989 | 968 | 5.97 | 719 |
| 85 | T | 4.0 | 40 | 1083 | <0.001 | <0.001 | 0 | 989 | 963 | 5.85 | 719 |
| 86 | T | 4.0 | 40 | 1048 | <0.001 | <0.001 | 0 | 987 | 968 | 5.88 | 719 |
| 87 | B | 2.3 | 40 | 1069 | 0.130 | 0.020 | 0.156 | 986 | 970 | 3.00 | 732 |
| 88 | B | 2.3 | 40 | 1056 | 0.130 | 0.020 | 0.156 | 992 | 968 | 3.13 | 732 |
| 89 | B | 2.3 | 40 | 1063 | 0.130 | 0.020 | 0.156 | 990 | 966 | 3.41 | 732 |
| 90 | B | 4.0 | 40 | 1074 | 0.130 | 0.020 | 0.156 | 985 | 950 | 5.50 | 719 |
| 91 | B | 4.0 | 40 | 1064 | 0.130 | 0.020 | 0.156 | 985 | 971 | 5.49 | 719 |
| 92 | B | 4.0 | 40 | 1061 | 0.130 | 0.020 | 0.156 | 987 | 972 | 5.91 | 719 |
| 93 | T | 4.0 | 40 | 1068 | <0.001 | <0.001 | 0 | 992 | 967 | 5.49 | 719 |
| 94 | T | 4.0 | 40 | 1071 | <0.001 | <0.001 | 0 | 991 | 966 | 5.91 | 719 |
| 95 | B | 2.4 | 40 | 1050 | 0.130 | 0.020 | 0.156 | 987 | 972 | 3.09 | 732 |
| 96 | B | 2.3 | 40 | 1065 | 0.130 | 0.020 | 0.156 | 991 | 972 | 3.30 | 732 |
| 97 | B | 2.3 | 40 | 1055 | 0.130 | 0.020 | 0.156 | 990 | 963 | 3.15 | 732 |
| 98 | B | 4.2 | 40 | 1060 | 0.130 | 0.020 | 0.156 | 989 | 965 | 5.75 | 719 |
| 99 | B | 4.1 | 40 | 1072 | 0.130 | 0.020 | 0.156 | 993 | 972 | 6.07 | 719 |
| 100 | B | 4.0 | 40 | 1072 | 0.130 | 0.020 | 0.156 | 987 | 967 | 5.97 | 719 |
| 101 | T | 4.1 | 40 | 1068 | <0.001 | <0.001 | 0 | 993 | 971 | 5.85 | 719 |
| 102 | T | 4.0 | 40 | 1054 | <0.001 | <0.001 | 0 | 986 | 968 | 6.02 | 719 |
| 103 | B | 2.3 | 40 | 987 | 0.130 | 0.020 | 0.156 | 971 | 953 | 3.80 | 732 |
| 104 | J | 2.9 | 40 | 1062 | 0.090 | 0.020 | 0.116 | 987 | 971 | 4.08 | 719 |
| 105 | J | 2.9 | 40 | 1066 | 0.090 | 0.020 | 0.116 | 987 | 972 | 4.34 | 719 |
| 106 | A | 2.9 | 40 | 1069 | 0.120 | 0.018 | 0.143 | 989 | 968 | 4.20 | 719 |

TABLE 5-continued

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (MASS %) | Nb (MASS %) | Ti + 1.3 Nb (MASS %) | FT1 (° C.) | FT2 (° C.) | t1 (mm) | D1 (mm) |
|---|---|---|---|---|---|---|---|---|---|---|---|
| 107 | A | 2.9 | 40 | 1049 | 0.120 | 0.018 | 0.143 | 985 | 963 | 4.44 | 719 |
| 108 | K | 2.9 | 40 | 1050 | 0.030 | 0.010 | 0.043 | 993 | 971 | 4.33 | 719 |

TABLE 6

| TEST MATERIAL No. | STEEL TYPE | SHEET THICKNESS tf (mm) | SHEET THICKNESS OF ROUGH-ROLLED SHEET (mm) | FINISH ROLLING START TEMPERATURE (° C.) | FINISH ROLLING CONDITIONS Ti (MASS %) | Nb (MASS %) | Ti + 1.3 Nb (MASS %) | FT1 (° C.) | FT2 (° C.) | t1 (mm) | D1 (mm) |
|---|---|---|---|---|---|---|---|---|---|---|---|
| 109 | K | 2.9 | 40 | 1072 | 0.030 | 0.010 | 0.043 | 987 | 966 | 4.35 | 719 |
| 110 | A | 2.9 | 30 | 1081 | 0.120 | 0.018 | 0.143 | 991 | 970 | 4.09 | 721 |
| 111 | A | 2.9 | 37 | 1079 | 0.120 | 0.018 | 0.143 | 986 | 972 | 4.18 | 719 |
| 112 | M | 3.3 | 45 | 1100 | 0.050 | 0.030 | 0.089 | 976 | 958 | 4.80 | 726 |
| 113 | N | 2.9 | 47 | 1086 | 0.170 | 0.005 | 0.177 | 978 | 965 | 4.30 | 720 |
| 114 | N | 2.9 | 40 | 1078 | 0.170 | 0.005 | 0.177 | 1025 | 980 | 4.40 | 725 |
| 115 | N | 2.9 | 42 | 1099 | 0.170 | 0.005 | 0.177 | 972 | 920 | 4.20 | 719 |
| 116 | Q | 2.9 | 40 | 1089 | 0.080 | 0.008 | 0.090 | 1013 | 1005 | 4.26 | 719 |
| 117 | Q | 2.9 | 40 | 1076 | 0.080 | 0.008 | 0.090 | 986 | 962 | 4.31 | 720 |
| 118 | V | 2.9 | 42 | 1065 | 0.090 | 0.010 | 0.103 | 1005 | 989 | 4.18 | 715 |
| 119 | N | 2.9 | 38 | 1101 | 0.170 | 0.005 | 0.177 | 996 | 979 | 4.55 | 711 |
| 120 | M | 2.9 | 42 | 990 | 0.050 | 0.030 | 0.089 | 962 | 949 | 4.19 | 712 |
| 121 | AH | 3.0 | 30 | 1250 | 0.021 | <0.001 | 0.021 | 1008 | 993 | 5.00 | 720 |
| 122 | AI | 2.0 | 40 | 1095 | 0.110 | <0.001 | 0.110 | 977 | 962 | 7.54 | 700 |
| 123 | AJ | 1.6 | 40 | 1088 | 0.070 | 0.035 | 0.116 | 903 | 872 | 2.36 | 705 |
| 124 | AK | 2.0 | 30 | 1250 | <0.001 | <0.001 | 0 | 970 | 960 | 5.56 | 710 |
| 125 | AL | 3.3 | 40 | 1095 | 0.130 | 0.001 | 0.131 | 995 | 972 | 4.60 | 720 |
| 126 | AM | 3.3 | 38 | 1077 | 0.100 | 0.002 | 0.103 | 977 | 965 | 4.95 | 700 |
| 127 | AN | 3.3 | 40 | 1082 | 0.080 | 0.002 | 0.083 | 971 | 965 | 4.66 | 710 |
| 128 | AO | 2.9 | 40 | 1085 | 0.115 | 0.003 | 0.119 | 986 | 966 | 4.48 | 712 |
| 129 | AP | 3.3 | 41 | 1099 | 0.090 | 0.002 | 0.093 | 991 | 975 | 4.92 | 711 |
| 130 | AQ | 3.3 | 40 | 1089 | 0.100 | 0.001 | 0.101 | 978 | 962 | 4.55 | 702 |
| 131 | AR | 2.9 | 39 | 1078 | 0.110 | 0.002 | 0.113 | 981 | 969 | 4.48 | 711 |
| 132 | AS | 2.9 | 42 | 1056 | 0.100 | 0.020 | 0.126 | 964 | 957 | 4.29 | 710 |
| 133 | AT | 3.3 | 41 | 1108 | 0.150 | 0.010 | 0.163 | 989 | 974 | 4.81 | 710 |
| 134 | AU | 3.3 | 40 | 1091 | 0.110 | 0.024 | 0.141 | 976 | 959 | 4.78 | 700 |
| 135 | AV | 2.9 | 39 | 1071 | 0.120 | 0.010 | 0.133 | 981 | 961 | 4.31 | 711 |
| 136 | AW | 3.3 | 40 | 1104 | 0.025 | <0.001 | 0.025 | 976 | 961 | 4.71 | 712 |
| 137 | AX | 2.9 | 40 | 1092 | 0.090 | 0.002 | 0.093 | 981 | 967 | 4.28 | 712 |
| 138 | AY | 3.3 | 38 | 1071 | 0.080 | 0.001 | 0.081 | 976 | 963 | 4.33 | 711 |
| 139 | AZ | 2.9 | 37 | 1069 | 0.120 | 0.002 | 0.123 | 982 | 969 | 4.15 | 701 |
| 140 | BA | 3.3 | 40 | 1072 | 0.100 | 0.001 | 0.101 | 983 | 968 | 4.35 | 701 |
| 141 | BB | 3.3 | 39 | 1092 | 0.090 | 0.002 | 0.093 | 985 | 972 | 4.61 | 703 |
| 142 | BC | 2.9 | 42 | 1081 | 0.112 | 0.021 | 0.139 | 995 | 973 | 4.05 | 710 |

TABLE 7

| TEST MATERIAL No. | STEEL TYPE | FINISH ROLLING CONDITIONS Sr1 | t2 (mm) | D2 (mm) | Sr2 | F1 (%) | F2 (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|
| 1 | A | 4.31 | 3.45 | 802 | 4.80 | 16.9 | 15.9 | 57 | 15 | 55.3 | B |
| 2 | B | 3.66 | 3.50 | 802 | 5.00 | 12.5 | 17.1 | 53 | 14 | 93.1 | B |
| 3 | C | 3.91 | 3.46 | 802 | 4.86 | 14.1 | 16.2 | 60 | 14 | 64.6 | B |

TABLE 7-continued

| TEST MATERIAL No. | STEEL TYPE | FINISH ROLLING CONDITIONS Sr1 | t2 (mm) | D2 (mm) | Sr2 | F1 (%) | F2 (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|
| 4 | D | 4.05 | 3.63 | 802 | 5.45 | 15.7 | 20.2 | 66 | 15 | 58.3 | B |
| 5 | E | 4.14 | 3.64 | 802 | 5.47 | 16.5 | 20.3 | 75 | 21 | 43.4 | B |
| 6 | F | 4.54 | 3.47 | 802 | 4.91 | 18.8 | 16.5 | 59 | 15 | 54.5 | B |
| 7 | G | 4.29 | 3.59 | 802 | 5.30 | 17.4 | 19.1 | 100 | 25 | 34.5 | B |
| 8 | H | 4.52 | 3.50 | 802 | 5.01 | 18.7 | 17.2 | 61 | 15 | 53.6 | Ms |
| 9 | I | 3.78 | 3.45 | 802 | 4.82 | 13.1 | 15.9 | 249 | 66 | 16.8 | Ms |
| 10 | J | 3.85 | 3.41 | 802 | 4.66 | 13.5 | 15.0 | 72 | 17 | 58.1 | B |
| 11 | K | 4.27 | 3.55 | 802 | 5.17 | 17.0 | 18.2 | 254 | 63 | 13.4 | B |
| 12 | L | 3.62 | 3.63 | 802 | 5.44 | 12.7 | 20.1 | 801 | 207 | 6.0 | B |
| 13 | M | 4.95 | 3.43 | 802 | 4.75 | 21.8 | 15.5 | 95 | 28 | 29.8 | B |
| 14 | N | 4.20 | 3.30 | 802 | 4.18 | 15.4 | 12.1 | 48 | 11 | 86.3 | B |
| 15 | O | 4.42 | 3.42 | 802 | 4.70 | 17.6 | 15.2 | 26 | 7 | 118.9 | B |
| 16 | P | 4.06 | 3.47 | 802 | 4.88 | 15.2 | 16.4 | 100 | 28 | 33.1 | B |
| 17 | Q | 4.25 | 3.61 | 802 | 5.37 | 17.2 | 19.6 | 97 | 23 | 36.7 | B |
| 18 | R | 4.22 | 3.54 | 802 | 5.15 | 16.6 | 18.1 | 47 | 11 | 78.0 | B |
| 19 | S | 3.54 | 3.58 | 802 | 5.27 | 12.0 | 18.9 | 23 | 6 | 275.8 | B |
| 20 | T | 3.47 | 3.64 | 802 | 5.48 | 11.8 | 20.4 | 787 | 191 | 8.2 | B |
| 21 | U | 3.47 | 3.63 | 802 | 5.43 | 11.7 | 20.0 | 86 | 18 | 78.7 | B |
| 22 | V | 4.56 | 3.47 | 802 | 4.91 | 19.0 | 16.5 | 83 | 22 | 37.7 | B |
| 23 | W | 3.91 | 3.58 | 802 | 5.28 | 14.5 | 19.0 | 85 | 22 | 44.0 | B |
| 24 | X | 4.09 | 3.59 | 802 | 5.33 | 15.9 | 19.3 | 71 | 18 | 49.3 | B |
| 25 | Y | 3.61 | 3.46 | 802 | 4.85 | 12.1 | 16.2 | 70 | 17 | 84.6 | B |
| 26 | Z | 4.17 | 3.44 | 802 | 4.78 | 15.8 | 15.7 | 76 | 19 | 45.3 | B |
| 27 | AA | 3.99 | 3.62 | 802 | 5.41 | 15.3 | 19.9 | 70 | 16 | 56.1 | B |
| 28 | AB | 4.65 | 3.52 | 802 | 5.09 | 19.9 | 17.7 | 60 | 16 | 51.5 | B |
| 29 | AC | 4.39 | 3.49 | 802 | 4.96 | 17.7 | 16.9 | 86 | 23 | 36.7 | B |
| 30 | AD | 4.31 | 3.47 | 802 | 4.87 | 17.0 | 16.3 | 56 | 14 | 59.7 | B |
| 31 | AE | 3.88 | 3.52 | 802 | 5.09 | 14.1 | 17.7 | — | — | — | B |
| 32 | AE | 4.32 | 3.49 | 802 | 4.96 | 17.2 | 16.9 | 105 | 25 | 32.3 | B |
| 33 | AF | 3.70 | 3.50 | 802 | 5.00 | 12.8 | 17.1 | — | — | — | B |
| 34 | AF | 4.41 | 3.51 | 802 | 5.05 | 17.9 | 17.5 | 83 | 22 | 38.8 | B |
| 35 | AG | 3.10 | 4.27 | 802 | 4.29 | 11.0 | 15.7 | 18 | 1 | 540.5 | B |
| 36 | AG | 3.92 | 4.27 | 802 | 4.29 | 17.2 | 15.7 | 34 | 10 | 76.7 | B |

TABLE 8

| TEST MATERIAL No. | STEEL TYPE | FINISH ROLLING CONDITIONS Sr1 | t2 (mm) | D2 (mm) | Sr2 | F1 (%) | F2 (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|
| 37 | A | 4.84 | 2.49 | 802 | 6.49 | 15.5 | 19.8 | 63 | 17 | 66.1 | B |
| 38 | A | 4.50 | 2.65 | 802 | 4.90 | 14.2 | 13.2 | 61 | 16 | 66.1 | B |
| 39 | A | 4.17 | 4.22 | 802 | 4.16 | 19.3 | 14.8 | 57 | 16 | 47.0 | B |
| 40 | A | 4.02 | 4.72 | 802 | 4.00 | 19.9 | 15.2 | 62 | 15 | 43.9 | B |
| 41 | A | 3.52 | 5.93 | 802 | 3.64 | 19.2 | 15.7 | 59 | 15 | 40.1 | B |
| 42 | A | 4.16 | 3.60 | 760 | 5.20 | 15.6 | 19.4 | 65 | 21 | 47.2 | B |
| 43 | A | 5.04 | 3.57 | 760 | 5.12 | 22.3 | 18.8 | 42 | 12 | 69.7 | B |
| 44 | A | 4.17 | 4.13 | 760 | 4.98 | 17.8 | 20.2 | 65 | 21 | 41.2 | B |
| 45 | A | 4.27 | 3.90 | 760 | 4.31 | 17.7 | 15.4 | 46 | 10 | 70.1 | B |
| 46 | A | 4.19 | 3.43 | 760 | 4.63 | 15.1 | 15.6 | 66 | 24 | 42.9 | Ms |
| 47 | A | 4.79 | 3.47 | 760 | 4.77 | 19.7 | 16.5 | 39 | 9 | 88.2 | Ms |
| 48 | O | 4.69 | 2.68 | 802 | 5.10 | 15.3 | 14.3 | 27 | 6 | 147.5 | B |
| 49 | M | 4.53 | 2.77 | 802 | 5.61 | 14.9 | 17.1 | 96 | 22 | 43.8 | B |
| 50 | N | 4.92 | 2.67 | 802 | 5.03 | 16.8 | 13.9 | 51 | 13 | 71.4 | B |
| 51 | S | 5.28 | 2.67 | 802 | 5.02 | 19.1 | 13.8 | 22 | 6 | 161.2 | B |
| 52 | R | 5.16 | 2.69 | 802 | 5.16 | 18.4 | 14.5 | 47 | 10 | 84.8 | B |
| 53 | Q | 4.79 | 2.86 | 802 | 6.04 | 17.0 | 19.7 | 103 | 25 | 38.0 | B |
| 54 | T | 4.49 | 2.65 | 802 | 4.90 | 14.0 | 13.2 | 828 | 187 | 5.4 | B |
| 55 | B | 4.35 | 2.76 | 802 | 5.55 | 13.6 | 16.8 | 28 | 5 | 180.1 | B |
| 56 | B | 5.28 | 2.80 | 802 | 5.74 | 20.0 | 17.9 | 36 | 11 | 87.2 | B |
| 57 | B | 4.65 | 2.87 | 802 | 6.07 | 16.1 | 19.9 | 40 | 12 | 87.4 | B |
| 58 | B | 4.03 | 4.85 | 802 | 4.31 | 20.5 | 17.5 | 25 | 5 | 131.2 | B |
| 59 | B | 4.02 | 4.91 | 802 | 4.43 | 20.7 | 18.5 | 35 | 9 | 76.0 | B |
| 60 | B | 3.96 | 4.79 | 802 | 4.18 | 19.6 | 16.5 | 43 | 13 | 56.0 | B |

TABLE 8-continued

| TEST MATERIAL No. | STEEL TYPE | FINISH ROLLING CONDITIONS Sr1 | t2 (mm) | D2 (mm) | Sr2 | F1 (%) | F2 (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|
| 61 | T | 3.53 | 4.87 | 802 | 4.36 | 16.0 | 17.9 | 510 | 50 | 11.3 | B |
| 62 | T | 4.01 | 4.77 | 802 | 4.13 | 20.1 | 16.2 | 610 | 115 | 5.3 | B |
| 63 | B | 4.35 | 2.70 | 802 | 5.18 | 13.3 | 14.7 | 54 | 4 | 170.4 | B |
| 64 | B | 4.74 | 2.66 | 802 | 4.97 | 15.5 | 13.6 | 55 | 9 | 92.3 | B |
| 65 | B | 4.50 | 2.65 | 802 | 4.90 | 14.0 | 13.2 | 52 | 12 | 85.9 | B |
| 66 | B | 3.36 | 4.96 | 802 | 4.53 | 14.9 | 19.3 | 57 | 4 | 128.4 | B |
| 67 | B | 4.08 | 4.85 | 802 | 4.32 | 21.1 | 17.6 | 53 | 8 | 71.8 | B |
| 68 | B | 3.34 | 4.98 | 802 | 4.59 | 14.8 | 19.8 | 55 | 11 | 68.3 | B |
| 69 | T | 3.86 | 4.88 | 802 | 4.37 | 19.0 | 18.0 | 831 | 110 | 5.3 | B |
| 70 | T | 3.70 | 4.79 | 802 | 4.16 | 17.3 | 16.4 | 768 | 155 | 4.2 | B |
| 71 | B | 5.80 | 2.75 | 802 | 5.48 | 11.9 | 16.4 | 57 | 14 | 122.1 | B |
| 72 | B | 4.47 | 2.63 | 802 | 4.77 | 12.6 | 12.5 | 53 | 15 | 96.3 | B |

TABLE 9

| TEST MATERIAL No. | STEEL TYPE | FINISH ROLLING CONDITIONS Sr1 | t2 (mm) | D2 (mm) | Sr2 | F1 (%) | F2 (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|
| 73 | B | 4.26 | 2.61 | 802 | 4.64 | 13.0 | 11.9 | 60 | 14 | 90.1 | B |
| 74 | B | 4.12 | 4.95 | 802 | 4.52 | 10.8 | 19.2 | 47 | 9 | 139.9 | B |
| 75 | B | 3.84 | 4.85 | 802 | 4.30 | 16.9 | 17.5 | 52 | 15 | 52.0 | B |
| 76 | B | 3.86 | 4.81 | 802 | 4.21 | 19.3 | 16.8 | 55 | 14 | 49.4 | B |
| 77 | T | 3.52 | 4.88 | 802 | 4.37 | 14.4 | 18.0 | 804 | 175 | 4.5 | B |
| 78 | T | 3.02 | 4.99 | 802 | 4.60 | 12.5 | 19.8 | 780 | 197 | 5.9 | B |
| 79 | B | 4.32 | 2.67 | 2000 | 7.95 | 13.1 | 13.9 | 55 | 15 | 103.3 | B |
| 80 | B | 4.50 | 2.70 | 800 | 5.20 | 14.3 | 14.8 | 54 | 15 | 70.1 | B |
| 81 | B | 4.55 | 2.72 | 700 | 4.97 | 14.7 | 15.5 | 53 | 15 | 66.2 | B |
| 82 | B | 2.97 | 5.01 | 2000 | 7.33 | 11.8 | 20.2 | 57 | 13 | 132.7 | B |
| 83 | B | 3.89 | 4.77 | 800 | 4.11 | 18.9 | 16.1 | 51 | 12 | 54.8 | B |
| 84 | B | 3.57 | 4.97 | 700 | 4.26 | 16.7 | 19.5 | 54 | 14 | 52.5 | B |
| 85 | T | 3.85 | 4.77 | 800 | 4.11 | 18.5 | 16.1 | 787 | 176 | 3.7 | B |
| 86 | T | 3.73 | 4.84 | 700 | 4.00 | 17.7 | 17.3 | 774 | 201 | 3.4 | B |
| 87 | B | 4.09 | 2.65 | 802 | 4.90 | 11.7 | 13.2 | 52 | 14 | 121.5 | B |
| 88 | B | 4.41 | 2.70 | 802 | 5.20 | 13.7 | 14.8 | 56 | 14 | 77.1 | B |
| 89 | B | 4.97 | 2.80 | 802 | 5.74 | 17.9 | 17.9 | 55 | 13 | 70.5 | B |
| 90 | B | 3.85 | 4.53 | 802 | 3.49 | 17.6 | 11.7 | 51 | 8 | 107.7 | B |
| 91 | B | 3.52 | 4.65 | 802 | 3.83 | 15.3 | 14.0 | 52 | 15 | 54.9 | B |
| 92 | B | 3.47 | 4.97 | 802 | 4.57 | 15.9 | 19.6 | 53 | 15 | 53.9 | B |
| 93 | T | 3.26 | 4.75 | 802 | 4.08 | 13.5 | 15.8 | 824 | 196 | 4.5 | B |
| 94 | T | 3.93 | 4.77 | 802 | 4.13 | 19.3 | 16.1 | 809 | 191 | 3.5 | B |
| 95 | B | 4.02 | 2.73 | 802 | 4.58 | 11.6 | 12.1 | 53 | 15 | 122.4 | B |
| 96 | B | 5.34 | 2.66 | 802 | 4.77 | 19.4 | 12.6 | 56 | 15 | 62.6 | B |
| 97 | B | 4.39 | 2.72 | 802 | 5.31 | 13.7 | 15.4 | 55 | 12 | 83.8 | B |
| 98 | B | 3.73 | 4.75 | 802 | 3.32 | 17.4 | 11.2 | 54 | 13 | 162.3 | B |
| 99 | B | 3.75 | 4.96 | 802 | 4.23 | 18.3 | 17.3 | 57 | 15 | 47.0 | B |
| 100 | B | 3.66 | 4.93 | 802 | 4.49 | 17.4 | 18.9 | 53 | 13 | 54.6 | B |
| 101 | T | 3.78 | 4.79 | 802 | 3.85 | 18.0 | 14.5 | 826 | 214 | 3.2 | B |
| 102 | T | 3.73 | 4.93 | 802 | 4.49 | 18.0 | 18.9 | 759 | 199 | 3.7 | B |
| 103 | B | 6.76 | 2.65 | 802 | 4.90 | 30.3 | 13.2 | 42 | 9 | 98.5 | B |
| 104 | J | 3.59 | 3.58 | 802 | 5.28 | 12.3 | 19.0 | 73 | 20 | 70.8 | F + B |
| 105 | J | 4.63 | 3.49 | 802 | 4.98 | 19.6 | 17.0 | 73 | 21 | 40.5 | Ms |
| 106 | A | 3.69 | 3.64 | 802 | 5.49 | 13.2 | 20.4 | 59 | 15 | 74.1 | F + B |
| 107 | A | 4.58 | 3.57 | 802 | 5.25 | 19.6 | 18.8 | 56 | 13 | 61.1 | Ms |
| 108 | K | 4.59 | 3.49 | 802 | 4.98 | 19.3 | 17.0 | 252 | 65 | 12.6 | F + B |

TABLE 10

| TEST MATERIAL No. | STEEL TYPE | FINISH ROLLING CONDITIONS Sr1 | t2 (mm) | D2 (mm) | Sr2 | F1 (%) | F2 (%) | CALCULATED VALUE USING CONDITIONAL EQUATION FT1* (° C.) | FT2* (° C.) | ω | COOLING AND COILING PATTERN |
|---|---|---|---|---|---|---|---|---|---|---|---|
| 109 | K | 4.32 | 3.59 | 802 | 5.30 | 17.6 | 19.1 | 232 | 57 | 14.8 | Ms |
| 110 | A | 4.77 | 3.29 | 802 | 4.13 | 19.6 | 11.9 | 61 | 16 | 60.9 | B |
| 111 | A | 3.73 | 3.62 | 802 | 5.41 | 13.4 | 19.9 | 57 | 16 | 69.8 | B |
| 112 | M | 4.30 | 3.90 | 802 | 4.43 | 18.8 | 15.4 | 84 | 19 | 38.1 | B |
| 113 | N | 4.14 | 3.60 | 800 | 5.34 | 16.3 | 19.4 | 41 | 11 | 81.5 | Ms |
| 114 | N | 4.54 | 3.56 | 800 | 5.21 | 19.1 | 18.5 | 69 | 16 | 51.1 | B |
| 115 | N | 4.06 | 3.55 | 801 | 5.18 | 15.5 | 18.3 | — | — | — | F + B |
| 116 | Q | 3.99 | 3.61 | 802 | 5.38 | 15.3 | 19.7 | 128 | 48 | 22.8 | B |
| 117 | Q | 5.33 | 3.28 | 801 | 4.05 | 24.0 | 11.5 | 95 | 21 | 53.6 | M |
| 118 | V | 5.16 | 3.24 | 802 | 3.88 | 22.5 | 10.5 | 102 | 33 | 94.6 | B |
| 119 | N | 3.98 | 3.82 | 802 | 5.98 | 16.1 | 24.0 | 52 | 15 | 65.3 | F + B |
| 120 | M | 3.78 | 3.61 | 802 | 5.38 | 13.8 | 19.7 | 66 | 13 | 69.6 | B |
| 121 | AH | 5.09 | 3.75 | 802 | 5.34 | 25.0 | 20.0 | 891 | 295 | 3.0 | Ms |
| 122 | AI | 7.22 | 3.77 | 800 | 10.28 | 50.0 | 47.0 | 67 | 17 | 85.0 | Ms |
| 123 | AJ | 6.73 | 1.84 | 802 | 5.83 | 22.0 | 13.0 | — | — | — | F + B |
| 124 | AK | 6.89 | 3.33 | 800 | 9.45 | 40.0 | 40.0 | 600 | 160 | 8.5 | F + B |
| 125 | AL | 4.17 | 3.80 | 800 | 4.08 | 17.4 | 13.2 | 70 | 18 | 43.6 | B |
| 126 | AM | 3.93 | 4.10 | 800 | 5.02 | 17.2 | 19.5 | 72 | 20 | 41.7 | B |
| 127 | AN | 3.22 | 4.12 | 800 | 5.07 | 11.6 | 19.9 | 84 | 25 | 68.5 | B |
| 128 | AO | 4.55 | 3.60 | 800 | 5.34 | 19.6 | 19.4 | 70 | 17 | 47.5 | B |
| 129 | AP | 4.75 | 3.81 | 800 | 4.12 | 22.6 | 13.4 | 98 | 28 | 27.3 | B |
| 130 | AQ | 3.36 | 3.99 | 801 | 4.71 | 12.3 | 17.3 | 74 | 19 | 69.5 | F + B |
| 131 | AR | 4.51 | 3.61 | 800 | 5.37 | 19.4 | 19.7 | 69 | 20 | 43.8 | B |
| 132 | AS | 4.59 | 3.46 | 800 | 4.85 | 19.3 | 16.2 | 47 | 13 | 65.2 | F + B |
| 133 | AT | 4.00 | 3.99 | 800 | 4.71 | 17.0 | 17.3 | 52 | 15 | 55.3 | F + B |
| 134 | AU | 4.31 | 3.86 | 800 | 4.29 | 19.2 | 14.5 | 50 | 12 | 61.1 | B |
| 135 | AV | 4.39 | 3.53 | 801 | 5.11 | 18.1 | 17.8 | 58 | 13 | 59.9 | B |
| 136 | AW | 4.42 | 3.79 | 802 | 4.05 | 19.5 | 12.9 | 440 | 110 | 7.0 | B |
| 137 | AX | 4.18 | 3.57 | 800 | 5.24 | 16.6 | 18.8 | 86 | 24 | 37.7 | B |
| 138 | AY | 3.41 | 3.81 | 800 | 4.12 | 12.0 | 13.4 | 93 | 25 | 63.2 | B |
| 139 | AZ | 4.40 | 3.41 | 801 | 4.66 | 17.8 | 15.0 | 64 | 18 | 46.2 | B |
| 140 | BA | 3.67 | 3.75 | 802 | 3.89 | 13.8 | 12.0 | 80 | 22 | 49.7 | B |
| 141 | BB | 4.34 | 3.74 | 803 | 3.86 | 18.9 | 11.8 | 91 | 27 | 37.0 | B |
| 142 | BC | 3.63 | 3.54 | 800 | 5.14 | 12.6 | 18.1 | 66 | 17 | 73.0 | B |

TABLE 11

| TEST MATERIAL No. | STEEL TYPE | TEXTURE SURFACE REGION AVERAGE OF POLE DENSITIES IN ORIENTATION GROUP A | STANDARD DEVIATION OF POLE DENSITIES IN ORIENTATION GROUP A | CENTRAL REGION POLE DENSITY IN ORIENTATION B | MECHANICAL PROPERTIES TENSILE STRENGTH TS (MPa) | TOTAL ELONGATION EL (%) | L-AXIS BENDING Rm/t | C-AXIS BENDING Rm/t | INVENTIVE OR COMPARATIVE |
|---|---|---|---|---|---|---|---|---|---|
| 1 | A | 2.4 | 1.5 | 5.3 | 1048 | 14 | 0.7 | 1.0 | INVENTIVE EXAMPLE |
| 2 | B | 2.9 | 1.8 | 7.6 | 1051 | 12 | 1.7 | 1.7 | INVENTIVE EXAMPLE |
| 3 | C | 2.6 | 1.5 | 7.1 | 1018 | 13 | 1.4 | 1.7 | INVENTIVE EXAMPLE |
| 4 | D | 2.5 | 1.0 | 5.6 | 1108 | 17 | 1.0 | 1.4 | INVENTIVE EXAMPLE |
| 5 | E | 2.3 | 1.2 | 5.1 | 763 | 21 | 1.0 | 1.4 | COMPARATIVE EXAMPLE |
| 6 | F | 2.4 | 1.3 | 5.5 | 983 | 15 | 0.7 | 1.4 | INVENTIVE EXAMPLE |
| 7 | G | 2.1 | 0.9 | 4.8 | 1181 | 12 | 0.7 | 0.7 | INVENTIVE EXAMPLE |
| 8 | H | 2.5 | 1.2 | 5.3 | 1269 | 9 | 2.8 | 3.1 | COMPARATIVE EXAMPLE |
| 9 | I | 1.3 | 0.5 | 4.8 | 772 | 14 | 0.1 | 0.1 | COMPARATIVE EXAMPLE |
| 10 | J | 2.5 | 1.4 | 6.3 | 803 | 22 | 0.3 | 1.0 | INVENTIVE EXAMPLE |
| 11 | K | 1.2 | 0.6 | 3.1 | 1138 | 11 | 1.0 | 1.0 | INVENTIVE EXAMPLE |
| 12 | L | 1.2 | 0.4 | 2.8 | 921 | 17 | 0.1 | 0.1 | INVENTIVE EXAMPLE |
| 13 | M | 1.8 | 0.9 | 4.1 | 983 | 15 | 0.7 | 1.0 | INVENTIVE EXAMPLE |
| 14 | N | 2.8 | 1.6 | 7.7 | 1088 | 12 | 1.7 | 1.7 | INVENTIVE EXAMPLE |
| 15 | O | 2.9 | 2.1 | 8.1 | 1095 | 10 | 1.4 | 2.4 | COMPARATIVE EXAMPLE |
| 16 | P | 1.8 | 1.0 | 4.6 | 943 | 15 | 0.2 | 0.3 | INVENTIVE EXAMPLE |
| 17 | Q | 2.0 | 0.9 | 4.9 | 1015 | 14 | 0.2 | 1.0 | INVENTIVE EXAMPLE |

TABLE 11-continued

| TEST MATERIAL No. | STEEL TYPE | TEXTURE: SURFACE REGION: AVERAGE OF POLE DENSITIES IN ORIENTATION GROUP A | TEXTURE: SURFACE REGION: STANDARD DEVIATION OF POLE DENSITIES IN ORIENTATION GROUP A | TEXTURE: CENTRAL REGION POLE DENSITY IN ORIENTATION B | MECHANICAL PROPERTIES: TENSILE STRENGTH TS (MPa) | MECHANICAL PROPERTIES: TOTAL ELONGATION EL (%) | MECHANICAL PROPERTIES: L-AXIS BENDING Rm/t | MECHANICAL PROPERTIES: C-AXIS BENDING Rm/t | INVENTIVE OR COMPARATIVE |
|---|---|---|---|---|---|---|---|---|---|
| 18 | R | 2.4 | 1.7 | 7.5 | 1038 | 12 | 1.0 | 1.7 | INVENTIVE EXAMPLE |
| 19 | S | 3.6 | 2.2 | 7.3 | 976 | 9 | 2.1 | 3.4 | COMPARATIVE EXAMPLE |
| 20 | T | 1.3 | 0.2 | 3.5 | 805 | 19 | 0.1 | 0.3 | INVENTIVE EXAMPLE |
| 21 | U | 2.9 | 1.7 | 7.4 | 1026 | 14 | 1.7 | 1.7 | INVENTIVE EXAMPLE |
| 22 | V | 2.3 | 1.1 | 4.1 | 1098 | 13 | 0.7 | 0.7 | INVENTIVE EXAMPLE |
| 23 | W | 2.2 | 1.2 | 5.2 | 1161 | 11 | 0.7 | 1.0 | INVENTIVE EXAMPLE |
| 24 | X | 2.2 | 1.1 | 5.4 | 1051 | 13 | 1.0 | 1.0 | INVENTIVE EXAMPLE |
| 25 | Y | 2.5 | 1.8 | 7.6 | 1071 | 12 | 1.0 | 1.7 | INVENTIVE EXAMPLE |
| 26 | Z | 2.3 | 0.8 | 4.8 | 1048 | 12 | 0.7 | 1.0 | INVENTIVE EXAMPLE |
| 27 | AA | 2.5 | 1.4 | 6.1 | 996 | 16 | 0.7 | 1.4 | INVENTIVE EXAMPLE |
| 28 | AB | 2.4 | 1.2 | 5.5 | 1096 | 13 | 0.7 | 0.7 | INVENTIVE EXAMPLE |
| 29 | AC | 2.0 | 0.8 | 4.2 | 1063 | 14 | 0.3 | 0.3 | INVENTIVE EXAMPLE |
| 30 | AD | 2.4 | 1.2 | 6.8 | 1084 | 13 | 1.0 | 1.4 | INVENTIVE EXAMPLE |
| 31 | AE | 3.5 | 2.8 | 8.1 | 798 | 19 | 2.4 | 2.8 | COMPARATIVE EXAMPLE |
| 32 | AE | 2.1 | 0.7 | 4.9 | 821 | 18 | 0.3 | 0.3 | INVENTIVE EXAMPLE |
| 33 | AF | 3.3 | 2.4 | 7.4 | 931 | 16 | 2.1 | 2.4 | COMPARATIVE EXAMPLE |
| 34 | AF | 2.2 | 1.0 | 4.6 | 953 | 17 | 1.4 | 1.4 | INVENTIVE EXAMPLE |
| 35 | AG | 3.0 | 3.1 | 6.3 | 1001 | 16 | 0.6 | 2.5 | COMPARATIVE EXAMPLE |
| 36 | AG | 2.9 | 1.8 | 7.6 | 998 | 17 | 0.6 | 1.9 | INVENTIVE EXAMPLE |

TABLE 12

| TEST MATERIAL No. | STEEL TYPE | TEXTURE: SURFACE REGION: AVERAGE OF POLE DENSITIES IN ORIENTATION GROUP A | TEXTURE: SURFACE REGION: STANDARD DEVIATION OF POLE DENSITIES IN ORIENTATION GROUP A | TEXTURE: CENTRAL REGION POLE DENSITY IN ORIENTATION B | MECHANICAL PROPERTIES: TENSILE STRENGTH TS (MPa) | MECHANICAL PROPERTIES: TOTAL ELONGATION EL (%) | MECHANICAL PROPERTIES: L-AXIS BENDING Rm/t | MECHANICAL PROPERTIES: C-AXIS BENDING Rm/t | INVENTIVE OR COMPARATIVE |
|---|---|---|---|---|---|---|---|---|---|
| 37 | A | 2.7 | 1.6 | 7.3 | 1052 | 12 | 1.3 | 1.7 | INVENTIVE EXAMPLE |
| 38 | A | 2.7 | 1.5 | 7.2 | 1044 | 11 | 1.0 | 1.7 | INVENTIVE EXAMPLE |
| 39 | A | 2.3 | 0.8 | 5.5 | 1060 | 15 | 0.2 | 0.3 | INVENTIVE EXAMPLE |
| 40 | A | 2.2 | 1.1 | 5.1 | 1056 | 14 | 0.5 | 1.0 | INVENTIVE EXAMPLE |
| 41 | A | 2.4 | 1.2 | 4.9 | 1048 | 14 | 0.6 | 1.0 | INVENTIVE EXAMPLE |
| 42 | A | 2.1 | 0.9 | 4.8 | 1018 | 16 | 0.2 | 0.2 | INVENTIVE EXAMPLE |
| 43 | A | 2.6 | 1.4 | 7.1 | 1051 | 14 | 1.7 | 1.7 | INVENTIVE EXAMPLE |
| 44 | A | 2.5 | 1.1 | 5.2 | 1044 | 15 | 0.9 | 0.9 | INVENTIVE EXAMPLE |
| 45 | A | 2.7 | 1.3 | 7.4 | 1068 | 13 | 1.2 | 1.8 | INVENTIVE EXAMPLE |
| 46 | A | 1.6 | 0.5 | 3.6 | 1198 | 9 | 1.0 | 1.0 | INVENTIVE EXAMPLE |
| 47 | A | 2.6 | 1.1 | 7.1 | 1199 | 10 | 1.4 | 1.7 | INVENTIVE EXAMPLE |
| 48 | O | 3.4 | 2.2 | 7.6 | 1103 | 9 | 2.2 | 2.6 | COMPARATIVE EXAMPLE |
| 49 | M | 2.5 | 1.2 | 5.1 | 991 | 13 | 0.9 | 1.3 | INVENTIVE EXAMPLE |
| 50 | N | 2.6 | 1.6 | 7.5 | 1089 | 12 | 1.3 | 1.7 | INVENTIVE EXAMPLE |
| 51 | S | 3.1 | 2.0 | 7.8 | 987 | 9 | 2.2 | 2.2 | COMPARATIVE EXAMPLE |
| 52 | R | 2.8 | 1.6 | 7.8 | 1044 | 11 | 1.7 | 1.7 | INVENTIVE EXAMPLE |
| 53 | Q | 2.1 | 0.8 | 4.3 | 1019 | 12 | 0.9 | 0.9 | INVENTIVE EXAMPLE |
| 54 | T | 1.4 | 0.4 | 2.8 | 821 | 18 | 0.1 | 0.1 | INVENTIVE EXAMPLE |
| 55 | B | 3.6 | 2.4 | 7.6 | 1019 | 11 | 2.2 | 2.6 | COMPARATIVE EXAMPLE |
| 56 | B | 2.8 | 1.7 | 7.4 | 1051 | 12 | 1.7 | 1.7 | INVENTIVE EXAMPLE |
| 57 | B | 2.7 | 1.8 | 7.3 | 1068 | 12 | 1.7 | 1.7 | INVENTIVE EXAMPLE |
| 58 | B | 3.2 | 2.1 | 7.5 | 1034 | 13 | 2.3 | 2.8 | COMPARATIVE EXAMPLE |
| 59 | B | 2.5 | 1.8 | 7.2 | 1064 | 13 | 1.3 | 1.8 | INVENTIVE EXAMPLE |
| 60 | B | 2.4 | 1.1 | 5.7 | 1059 | 13 | 0.8 | 0.8 | INVENTIVE EXAMPLE |
| 61 | T | 1.6 | 0.7 | 3.1 | 819 | 21 | 0.1 | 0.3 | INVENTIVE EXAMPLE |
| 62 | T | 1.3 | 0.5 | 2.1 | 831 | 19 | 0.1 | 0.1 | INVENTIVE EXAMPLE |
| 63 | B | 3.6 | 2.6 | 7.2 | 1021 | 11 | 1.7 | 3.0 | COMPARATIVE EXAMPLE |

TABLE 12-continued

| | | TEXTURE | | | | | | | |
|---|---|---|---|---|---|---|---|---|---|
| | | SURFACE REGION | | | | | | | |
| | | AVERAGE OF POLE | STANDARD DEVIATION OF POLE | CENTRAL REGION POLE | MECHANICAL PROPERTIES | | | | |
| TEST MATERIAL No. | STEEL TYPE | DENSITIES IN ORIENTATION GROUP A | DENSITIES IN ORIENTATION GROUP A | DENSITY IN ORIENTATION B | TENSILE STRENGTH TS (MPa) | TOTAL ELONGATION EL (%) | L-AXIS BENDING Rm/t | C-AXIS BENDING Rm/t | INVENTIVE OR COMPARATIVE |
| 64 | B | 2.9 | 1.9 | 7.5 | 1036 | 12 | 1.7 | 1.7 | INVENTIVE EXAMPLE |
| 65 | B | 2.8 | 1.6 | 7.1 | 1018 | 13 | 0.9 | 1.7 | INVENTIVE EXAMPLE |
| 66 | B | 3.3 | 2.1 | 7.3 | 1061 | 12 | 2.3 | 2.5 | COMPARATIVE EXAMPLE |
| 67 | B | 2.3 | 1.7 | 7.5 | 1042 | 13 | 1.5 | 1.8 | INVENTIVE EXAMPLE |
| 68 | B | 2.2 | 1.7 | 7.1 | 1019 | 14 | 1.5 | 1.8 | INVENTIVE EXAMPLE |
| 69 | T | 1.5 | 0.7 | 2.7 | 833 | 19 | 0.3 | 0.3 | INVENTIVE EXAMPLE |
| 70 | T | 1.2 | 0.6 | 2.1 | 811 | 20 | 0.1 | 0.1 | INVENTIVE EXAMPLE |
| 71 | B | 3.2 | 2.4 | 7.1 | 1051 | 11 | 2.2 | 2.8 | COMPARATIVE EXAMPLE |
| 72 | B | 2.4 | 1.8 | 7.9 | 1047 | 13 | 0.9 | 1.7 | INVENTIVE EXAMPLE |

TABLE 13

| | | TEXTURE | | | | | | | |
|---|---|---|---|---|---|---|---|---|---|
| | | SURFACE REGION | | | | | | | |
| | | AVERAGE OF POLE | STANDARD DEVIATION OFPOLE | CENTRAL REGION POLE | MECHANICAL PROPERTIES | | | | |
| TEST MATERIAL No. | STEEL TYPE | DENSITIES IN ORIENTATION GROUP A | DENSITIES IN ORIENTATION GROUP A | DENSITY IN ORIENTATION B | TENSILE STRENGTH TS (MPa) | TOTAL ELONGATION EL (%) | L-AXIS BENDING Rm/t | C-AXIS BENDING Rm/t | INVENTIVE OR COMPARATIVE |
| 73 | B | 2.7 | 1.4 | 7.1 | 1022 | 12 | 1.7 | 1.7 | INVENTIVE EXAMPLE |
| 74 | B | 3.4 | 2.1 | 7.3 | 1034 | 11 | 2.3 | 2.5 | COMPARATIVE EXAMPLE |
| 75 | B | 2.1 | 1.1 | 5.5 | 1026 | 14 | 0.8 | 1.0 | INVENTIVE EXAMPLE |
| 76 | B | 2.3 | 1.3 | 6.1 | 1041 | 14 | 0.8 | 1.0 | INVENTIVE EXAMPLE |
| 77 | T | 1.4 | 0.7 | 2.7 | 825 | 19 | 0.1 | 0.1 | INVENTIVE EXAMPLE |
| 78 | T | 1.6 | 0.8 | 2.1 | 825 | 19 | 0.3 | 0.1 | INVENTIVE EXAMPLE |
| 79 | B | 3.1 | 2.2 | 7.3 | 1048 | 11 | 2.2 | 2.2 | COMPARATIVE EXAMPLE |
| 80 | B | 2.5 | 1.6 | 7.1 | 1039 | 13 | 1.3 | 1.7 | INVENTIVE EXAMPLE |
| 81 | B | 2.8 | 1.3 | 7.8 | 1061 | 13 | 1.7 | 1.7 | INVENTIVE EXAMPLE |
| 82 | B | 3.3 | 2.3 | 7.4 | 1055 | 12 | 2.3 | 2.5 | COMPARATIVE EXAMPLE |
| 83 | B | 2.2 | 1.4 | 6.3 | 1047 | 13 | 0.8 | 1.0 | INVENTIVE EXAMPLE |
| 84 | B | 2.4 | 1.1 | 5.9 | 1026 | 14 | 1.0 | 1.0 | INVENTIVE EXAMPLE |
| 85 | T | 1.1 | 0.7 | 3.1 | 814 | 19 | 0.3 | 0.1 | INVENTIVE EXAMPLE |
| 86 | T | 1.3 | 0.8 | 2.1 | 831 | 18 | 0.1 | 0.1 | INVENTIVE EXAMPLE |
| 87 | B | 3.5 | 2.3 | 7.6 | 1063 | 11 | 2.8 | 3.0 | COMPARATIVE EXAMPLE |
| 88 | B | 2.7 | 1.5 | 7.3 | 1041 | 12 | 1.7 | 1.7 | INVENTIVE EXAMPLE |
| 89 | B | 2.2 | 1.7 | 7.1 | 1061 | 13 | 1.3 | 1.7 | INVENTIVE EXAMPLE |
| 90 | B | 3.2 | 2.1 | 8.1 | 1055 | 12 | 2.5 | 3.0 | COMPARATIVE EXAMPLE |
| 91 | B | 2.0 | 1.4 | 6.1 | 1047 | 13 | 0.5 | 0.8 | INVENTIVE EXAMPLE |
| 92 | B | 2.5 | 1.1 | 5.7 | 1026 | 13 | 0.8 | 0.8 | INVENTIVE EXAMPLE |
| 93 | T | 1.2 | 0.6 | 3.5 | 814 | 20 | 0.1 | 0.1 | INVENTIVE EXAMPLE |
| 94 | T | 1.3 | 1.0 | 2.1 | 831 | 18 | 0.1 | 0.3 | INVENTIVE EXAMPLE |
| 95 | B | 3.3 | 2.5 | 8.1 | 1073 | 10 | 2.5 | 3.3 | COMPARATIVE EXAMPLE |
| 96 | B | 2.7 | 1.4 | 7.6 | 1048 | 12 | 1.3 | 1.7 | INVENTIVE EXAMPLE |
| 97 | B | 2.8 | 1.7 | 7.5 | 1062 | 13 | 1.7 | 1.7 | INVENTIVE EXAMPLE |
| 98 | B | 3.1 | 2.5 | 7.7 | 1047 | 12 | 2.6 | 3.1 | COMPARATIVE EXAMPLE |
| 99 | B | 2.4 | 1.3 | 5.4 | 1031 | 13 | 0.7 | 0.7 | INVENTIVE EXAMPLE |
| 100 | B | 2.5 | 1.7 | 6.1 | 1028 | 14 | 0.5 | 0.8 | INVENTIVE EXAMPLE |
| 101 | T | 1.1 | 0.8 | 3.4 | 835 | 17 | 0.1 | 0.1 | INVENTIVE EXAMPLE |
| 102 | T | 1.3 | 0.7 | 2.2 | 819 | 19 | 0.1 | 0.3 | INVENTIVE EXAMPLE |
| 103 | B | 3.1 | 1.9 | 7.3 | 1093 | 9 | 2.3 | 2.3 | COMPARATIVE EXAMPLE |
| 104 | J | 2.6 | 1.8 | 7.3 | 783 | 24 | 1.0 | 1.7 | INVENTIVE EXAMPLE |
| 105 | J | 2.1 | 1.4 | 6.3 | 969 | 11 | 1.0 | 1.0 | INVENTIVE EXAMPLE |
| 106 | A | 2.5 | 1.6 | 7.2 | 986 | 15 | 1.7 | 1.7 | INVENTIVE EXAMPLE |
| 107 | A | 2.3 | 1.4 | 7.6 | 1201 | 9 | 1.0 | 1.7 | INVENTIVE EXAMPLE |
| 108 | K | 1.8 | 0.8 | 3.0 | 1100 | 13 | 0.3 | 0.3 | INVENTIVE EXAMPLE |

TABLE 14

| | | TEXTURE | | | | | | | |
|---|---|---|---|---|---|---|---|---|---|
| | | SURFACE REGION | | | | | | | |
| | | AVERAGE OF POLE | STANDARD DEVIATION OF POLE | CENTRAL REGION POLE | MECHANICAL PROPERTIES | | | | |
| TEST MATERIAL No. | STEEL TYPE | DENSITIES IN ORIENTATION GROUP A | DENSITIES IN ORIENTATION GROUP A | DENSITY IN ORIENTATION B | TENSILE STRENGTH TS (MPa) | TOTAL ELONGATION EL (%) | L-AXIS BENDING Rm/t | C-AXIS BENDING Rm/t | INVENTIVE OR COMPARATIVE |
| 109 | K | 1.6 | 1.0 | 2.9 | 1268 | 7 | 0.3 | 0.7 | INVENTIVE EXAMPLE |
| 110 | A | 3.3 | 2.4 | 7.2 | 1080 | 12.6 | 2.1 | 2.8 | COMPARATIVE EXAMPLE |
| 111 | A | 2.5 | 0.6 | 7.8 | 1092 | 11.5 | 1.4 | 1.7 | INVENTIVE EXAMPLE |
| 112 | M | 2.3 | 1.2 | 5.8 | 991 | 16 | 0.6 | 0.9 | INVENTIVE EXAMPLE |
| 113 | N | 3.2 | 2.1 | 8.2 | 1215 | 10.5 | 2.1 | 2.4 | COMPARATIVE EXAMPLE |
| 114 | N | 2.9 | 2.1 | 7.5 | 1069 | 14.3 | 1.0 | 2.1 | COMPARATIVE EXAMPLE |
| 115 | N | 3.4 | 2.8 | 8.3 | 996 | 15.1 | 1.7 | 2.4 | COMPARATIVE EXAMPLE |
| 116 | Q | 2.8 | 2.8 | 7.2 | 981 | 12.3 | 1.7 | 2.1 | COMPARATIVE EXAMPLE |
| 117 | Q | 3.0 | 2.3 | 7.6 | 1260 | 10.6 | 2.1 | 2.4 | COMPARATIVE EXAMPLE |
| 118 | V | 3.5 | 2.4 | 9.0 | 1066 | 14.2 | 1.7 | 2.8 | COMPARATIVE EXAMPLE |
| 119 | N | 2.9 | 2.5 | 7.2 | 989 | 16.8 | 1.4 | 2.1 | COMPARATIVE EXAMPLE |
| 120 | M | 3.4 | 2.4 | 8.3 | 1022 | 16.4 | 1.7 | 2.4 | COMPARATIVE EXAMPLE |
| 121 | AH | 2.4 | 2.9 | 5.6 | 965 | 17.5 | 1.7 | 2.3 | COMPARATIVE EXAMPLE |
| 122 | AI | 3.1 | 2.5 | 7.9 | 1208 | 8.3 | 2.0 | 2.5 | COMPARATIVE EXAMPLE |
| 123 | AJ | 3.3 | 2.2 | 7.4 | 987 | 7.3 | 1.9 | 2.5 | COMPARATIVE EXAMPLE |
| 124 | AK | 2.1 | 2.4 | 3.2 | 1016 | 21.5 | 1.0 | 2.5 | COMPARATIVE EXAMPLE |
| 125 | AL | 2.3 | 1.4 | 4.8 | 1062 | 16.5 | 0.9 | 0.9 | INVENTIVE EXAMPLE |
| 126 | AM | 2.0 | 1.6 | 5.2 | 1131 | 12.3 | 0.6 | 0.9 | INVENTIVE EXAMPLE |
| 127 | AN | 2.8 | 1.9 | 7.3 | 1106 | 14.5 | 1.2 | 1.8 | INVENTIVE EXAMPLE |
| 128 | AO | 2.5 | 1.8 | 6.5 | 1025 | 14.6 | 0.7 | 1.0 | INVENTIVE EXAMPLE |
| 129 | AP | 2.4 | 1.6 | 4.9 | 1092 | 15.8 | 0.9 | 0.9 | INVENTIVE EXAMPLE |
| 130 | AQ | 2.8 | 1.6 | 7.5 | 1077 | 16.8 | 1.2 | 1.8 | INVENTIVE EXAMPLE |
| 131 | AR | 2.3 | 1.3 | 4.9 | 1083 | 15.1 | 0.7 | 1.0 | INVENTIVE EXAMPLE |
| 132 | AS | 2.8 | 1.8 | 7.2 | 1081 | 16.9 | 1.0 | 1.7 | INVENTIVE EXAMPLE |
| 133 | AT | 2.6 | 1.7 | 5.6 | 992 | 15.3 | 0.9 | 0.9 | INVENTIVE EXAMPLE |
| 134 | AU | 2.6 | 1.9 | 7.3 | 1109 | 12.6 | 0.9 | 1.8 | INVENTIVE EXAMPLE |
| 135 | AV | 2.8 | 1.4 | 6.5 | 1121 | 12 | 0.7 | 1.0 | INVENTIVE EXAMPLE |
| 136 | AW | 1.2 | 1.0 | 4.2 | 1028 | 16.2 | 0.3 | 0.6 | INVENTIVE EXAMPLE |
| 137 | AX | 2.2 | 1.5 | 5.1 | 1001 | 17.2 | 0.7 | 0.7 | INVENTIVE EXAMPLE |
| 138 | AY | 2.7 | 1.7 | 7.2 | 994 | 14.6 | 0.9 | 1.7 | INVENTIVE EXAMPLE |
| 139 | AZ | 2.2 | 1.6 | 6.1 | 1021 | 17.1 | 0.7 | 0.7 | INVENTIVE EXAMPLE |
| 140 | BA | 2.3 | 1.5 | 5.4 | 1086 | 14.5 | 0.6 | 0.9 | INVENTIVE EXAMPLE |
| 141 | BB | 2.1 | 1.4 | 4.9 | 1103 | 16.5 | 0.6 | 0.9 | INVENTIVE EXAMPLE |
| 142 | BC | 2.8 | 1.8 | 7.6 | 999 | 14.3 | 1.0 | 1.7 | INVENTIVE EXAMPLE |

INDUSTRIAL APPLICABILITY

According to the aspects of the present invention, it is possible to obtain a hot-rolled steel sheet having a tensile strength (maximum tensile strength) of 780 MPa or more, excellent bending workability, and small anisotropy in bending workability. Accordingly, the present invention has significant industrial applicability.

What is claimed is:

1. A hot-rolled steel sheet comprising: a chemical composition consisting of, by mass %, 0.030 to 0.400% of C;
0.050 to 2.5% of Si;
1.00 to 4.00% of Mn;
0.001 to 2.0% of sol.Al;
0 to 0.20% of Ti;
0 to 0.20% of Nb;
0 to 0.010% of B;
0 to 1.0% of V;
0 to 1.0% of Cr;
0 to 1.0% of Mo;
0 to 1.0% of Cu;
0 to 1.0% of Co;
0 to 1.0% of W;
0 to 1.0% of Ni;
0 to 0.01% of Ca;
0 to 0.01% of Mg;
0 to 0.01% of REM;
0 to 0.01% of Zr;
limited to 0.020% or less of P;
limited to 0.020% or less of S;
limited to 0.010% or less of N; and
a balance of Fe and impurities, and wherein, when a surface region is from a sheet surface to 1/10 of a sheet thickness, an average of pole densities in a crystal orientation group consisting of {110}<110>to {110}<001>in the surface region is 0.5 to 3.0, and a standard deviation of the pole densities in the crystal orientation group is 0.2 to 2.0, and wherein a tensile strength is 780 to 1370 MPa.

2. The hot-rolled steel sheet according to claim 1, wherein, when a central region is from 3/8 to 5/8 of the sheet thickness based on the sheet surface, a pole density in a crystal orientation of {334}<263>is 1.0 to 7.0.

3. The hot-rolled steel sheet according to claim 1, the hot-rolled steel sheet comprising, as the chemical composition, by mass %, at least one of:

0.001 to 0.20% of Ti;
0.001 to 0.20% of Nb;
0.001 to 0.010% of B;
0.005 to 1.0% of V;
0.005 to 1.0% of Cr;
0.005 to 1.0% of Mo;
0.005 to 1.0% of Cu;
0.005 to 1.0% of Co;
0.005 to 1.0% of W;
0.005 to 1.0% of Ni;
0.0003 to 0.01% of Ca;
0.0003 to 0.01% of Mg;
0.0003 to 0.01% of REM; and
0.0003 to 0.01% of Zr.

4. The hot-rolled steel sheet according to claim 2, the hot-rolled steel sheet comprising, as the chemical composition, by mass %, at least one of:

0.001 to 0.20% of Ti;
0.001 to 0.20% of Nb;
0.001 to 0.010% of B;
0.005 to 1.0% of V;
0.005 to 1.0% of Cr;
0.005 to 1.0% of Mo;
0.005 to 1.0% of Cu;
0.005 to 1.0% of Co;
0.005 to 1.0% of W;
0.005 to 1.0% of Ni;
0.0003 to 0.01% of Ca;
0.0003 to 0.01% of Mg;
0.0003 to 0.01% of REM; and
0.0003 to 0.01% of Zr.

5. A hot-rolled steel sheet comprising: as a chemical composition, by mass %, 0.030 to 0.400% of C;
0.050 to 2.5% of Si;
1.00 to 4.00% of Mn;
0.001 to 2.0% of sol.Al;
0 to 0.20% of Ti;
0 to 0.20% of Nb;
0 to 0.010% of B;
0 to 1.0% of V;
0 to 1.0% of Cr;
0 to 1.0% of Mo;
0 to 1.0% of Cu;
0 to 1.0% of Co;
0 to 1.0% of W;
0 to 1.0% of Ni;
0 to 0.01% of Ca;
0 to 0.01% of Mg;
0 to 0.01% of REM;
0 to 0.01% of Zr;
0.020% or less of P;
0.020% or less of S;
0.010% or less of N; and
a balance comprising Fe and impurities, and
wherein, when a surface region is from a sheet surface to 1/10 of a sheet thickness, an average of pole densities in a crystal orientation group comprising {110}<110>to {110}<001>in the surface region is 0.5 to 3.0, and a standard deviation of the pole densities in the crystal orientation group is 0.2 to 2.0, and
wherein a tensile strength is 780 to 1370 MPa.

* * * * *